US007147309B2

(12) United States Patent
Sakai et al.

(10) Patent No.: US 7,147,309 B2
(45) Date of Patent: Dec. 12, 2006

(54) LIQUID CARTRIDGE

(75) Inventors: Yasuto Sakai, Fukui-ken (JP); Satoshi Shinada, Nagano-ken (JP); Taku Ishizawa, Nagano-ken (JP); Akira Ichihashi, Nagano-ken (JP); Yuichi Seki, Nagano-ken (JP); Akihiko Kitazawa, Nagano-ken (JP); Kenji Ito, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 51 days.

(21) Appl. No.: 10/730,785

(22) Filed: Dec. 8, 2003

(65) Prior Publication Data

US 2004/0165043 A1 Aug. 26, 2004

(30) Foreign Application Priority Data

| | | |
|---|---|---|
| Dec. 10, 2002 | (JP) | 2002-358762 |
| Dec. 10, 2002 | (JP) | 2002-358763 |
| Dec. 25, 2002 | (JP) | 2002-374645 |
| Jul. 31, 2003 | (JP) | 2003-204774 |

(51) Int. Cl.
*B41J 2/175* (2006.01)

(52) U.S. Cl. ..... 347/85; 347/86

(58) Field of Classification Search ..... 347/19, 347/85, 86, 87; 141/2, 18
See application file for complete search history.

(56) References Cited

U.S. PATENT DOCUMENTS

| | | | | |
|---|---|---|---|---|
| 5,040,002 | A * | 8/1991 | Pollacek et al. | 347/87 |
| 6,648,460 | B1 * | 11/2003 | Gonzales | 347/86 |
| 6,666,552 | B1 * | 12/2003 | Anderson et al. | 347/86 |
| 6,773,099 | B1 * | 8/2004 | Inoue et al. | 347/86 |
| 6,863,388 | B1 * | 3/2005 | Seino et al. | 347/86 |
| 2001/0010531 | A1 | 8/2001 | Hsieh et al. | |
| 2002/0109760 | A1 | 8/2002 | Miyazawa et al. | |

FOREIGN PATENT DOCUMENTS

| | | | |
|---|---|---|---|
| CN | 1365893 | A | 8/2002 |
| EP | 1 199 178 | A | 4/2002 |
| EP | 1 199 788 | A | 4/2002 |
| JP | 6-286151 | A | 10/1994 |
| JP | 2000-343722 | A | 12/2000 |
| JP | 2001-341324 | A | 12/2001 |
| JP | 2002-103643 | A | 4/2002 |

OTHER PUBLICATIONS

Office Action in Chinese Patent Appln. 200310118233.3 (Jun. 2, 2006), English translation only.
Office Action in chinese Patent Appln. 200310118233.3 (Dec. 2, 2005), with English translation.
Office Action in Japanese Patent Appln. 2003-204774 (Sep. 1, 2005), with English translation.

* cited by examiner

*Primary Examiner*—Anh T. N. Vo
(74) *Attorney, Agent, or Firm*—Stroock & Stroock & Lavan LLP

(57) ABSTRACT

An ink cartridge is provided with an ink accommodating section for containing ink, an ink supplying part for supplying ink contained in the ink accommodating section to an inkjet type recording apparatus by inserting an ink supplying needle provided at a lower part of the inkjet type recording apparatus, and an atmospheric valve, which seals a communicating hole in order that the ink accommodating section and the atmosphere communicate, while opening a communicating hole, which allows the ink accommodating section to communicates with the atmosphere, by moving perpendicular to a direction in which the ink cartridge is inserted into the inkjet type recording apparatus by being pushed up by a contact member.

19 Claims, 19 Drawing Sheets

LIQUID CARTRIDGE

BACKGROUND OF THE INVENTION

This application claims priority from Japanese Patent Applications Nos. 2002-358762 filed on Dec. 10, 2002, 2002-358763 filed on Dec. 10, 2002, 2002-374645 filed on Dec. 25, 2002, and 2003-204774 filed on Jul. 31, 2003, the contents of which are incorporated herein by reference.

1. Field of the Invention

The present invention relates to a liquid cartridge. More particularly, the present invention relates to a liquid cartridge for supplying a liquid to a liquid ejecting apparatus on which the liquid cartridge is mounted.

2. Description of the Related Art

In an inkjet type recording apparatus, an ink cartridge containing ink supplies the ink to a recording head while being mounted onto the inkjet type recording apparatus. Here, the ink, inkjet type recording apparatus and ink cartridge are examples of the liquid, liquid ejecting apparatus and liquid cartridge, respectively.

An ink cartridge is provided, for example, with an ink accommodating section in which ink is contained, an ink supplying part for supplying ink in the ink accommodating section, into which an ink supplying needle projecting from the carriage is inserted, to a recording head, a valve member for allowing the ink accommodating section and the ink supplying part to communicate with each other based on a pressure difference between the ink accommodating section side and the recording head side and an atmospheric valve for allowing the ink containing chamber and the atmosphere to communicate with each other as disclosed, for example, in Japanese Patent Application Publication No. 2002-103643. The atmospheric valve is arranged to be capable of moving perpendicular to a direction in which the ink cartridge is mounted on to the carriage. For example, when the ink cartridge is mounted onto the carriage by being pushed inside downwardly, the atmospheric valve is arranged to be capable of moving in a horizontal direction. As the ink cartridge is mounted on the carriage, a contact member, which is a part of the carriage, is in contact with the atmospheric valve, then the atmospheric valve is moved in a horizontal direction and then the ink accommodating section communicates with the atmosphere. At this state, when the recording head consumes ink, an ink supply controlling means supplies ink to recording head from the ink accommodating section.

However, in the ink cartridge above, since the contact member of the carriage moves the atmospheric valve in a direction perpendicular to a direction in which the ink cartridge is mounted, the atmospheric valve might not open because the contact member is not in contact with the atmospheric valve by the looseness of the atmosphere or the looseness of the contact member of the carriage when the ink cartridge is mounted onto the carriage. Moreover, in the ink cartridge above, the ink contained in the ink accommodating section might leak out of the ink cartridge through the communicating hole.

SUMMARY OF THE INVENTION

Therefore, it is an object of the present invention to provide a liquid cartridge and a method for assembling a liquid cartridge, which are capable of overcoming the above drawbacks accompanying the conventional art. The above and other objects can be achieved by combinations described in the independent claims. The dependent claims define further advantageous and exemplary combinations of the present invention.

According to the first aspect of the present invention, a liquid cartridge for supplying a liquid to a liquid ejecting apparatus through a liquid supplying needle thereof when mounted on said liquid ejecting apparatus, comprises: a liquid accommodating section for containing a liquid; a liquid supplying part, which communicates with said liquid accommodating section, said liquid supplying part including an opening into which the liquid supplying needle of the liquid ejecting apparatus is inserted; and an atmospheric valve for sealing a communicating hole which allows said liquid accommodating section to communicate with atmosphere, said atmospheric valve moving substantially in a direction parallel to a direction in which the liquid supplying needle is inserted into said opening of said liquid supplying part.

Due to this configuration, since the moving direction of the atmospheric valve is parallel to the insertion direction of the liquid supplying needle of the liquid ejecting apparatus into the liquid supplying part, the atmosphere vale is securely pushed up by the contact member of the liquid ejecting apparatus accompanying mounting of the liquid cartridge. Further, if the outer shape of the liquid cartridge is wide in the direction in which the liquid cartridge is mounted, it is possible to increase the stroke that the atmospheric valve moves without broadening the width of the liquid cartridge.

The liquid cartridge may further comprise a coil spring for urging the atmospheric valve toward the communicating hole in order to seal the communicating hole. Due to this, it is possible to increase the stroke that the coil spring is contracted, and to increase the urging force to urge the atmospheric valve in the direction in which the communicating hole is sealed, in comparison to a case of using a leaf spring.

In the liquid cartridge, the atmospheric valve may comprise a guide part of substantially cylindrical shape and is inserted into the coil spring and a disc part, which has a diameter larger than the guide part and is urged by the coil spring in order to seal around the communicating hole, and a notch part, which is cut in from a side into which the coil spring is inserted, being provided at the guide part. Due to this, since the atmospheric valve and the coil spring can be temporarily stopped by fitting an assembly fixture into the notched part in the state wherein the guide part of the atmospheric valve is inserted into the coil spring, it is possible to easily assemble the atmospheric valve and the coil spring to the ink cartridge.

In the liquid cartridge, the atmospheric valve may comprise a sealing part, which is urged in order to seal around the communicating hole and a shaft part, which extends from the sealing part, is inserted into the communicating hole and touches the communicating hole internally at a plurality of places, wherein a gap may be formed between the shaft part and the communicating hole.

Due to this, the atmospheric valve is exactly positioned at a plurality of places in regard to the communicating hole. In addition, since the gaps are formed between the contact places, it is possible to prevent the increase of the passage resistance of the atmosphere flowing through the communicating hole.

In the liquid cartridge, a film may be formed at a part of the liquid cartridge, with which a contact member of the liquid ejecting apparatus is in contact, and the atmospheric valve may be moved by being pushed by the contact member via the film having a flexure.

Due to this, when the contact member of the liquid ejecting apparatus pushes up the atmospheric valve via the film, it is possible to prevent the film from being expanded and broken. In addition, it is possible to reduce the resistance in order to push the film.

The liquid cartridge may further comprise a liquid keeping part, which is provided at a position closer to atmosphere than the communicating hole, below the atmospheric valve and the communicating hole, for keeping a liquid, which flows out of the communicating hole. Due to this, although the liquid flows out toward the vicinity of the atmosphere rather than the communicating hole and the atmospheric valve, the ink is kept in the liquid keeping chamber. Therefore, it is possible to prevent the liquid from leaking out of the liquid cartridge.

In the liquid cartridge, a keeping part communicating hole maybe provided at an upper part of the liquid keeping part to allow atmosphere and the communicating hole of the liquid accommodating section to communicate. Due to this, although the liquid flows out toward the communicating hole and the atmospheric valve, it is possible to reduce the passage resistance of the atmosphere through the communicating hole by allowing the liquid to flow from the communicating hole to the liquid keeping part.

In the liquid cartridge, the liquid keeping part may comprise a hollow part, of which a bottom face is opened, and a film for sealing the hollow part, and the liquid cartridge may further comprise an atmospheric valve pushing member, which is contained in the hollow part of the liquid keeping part, for pushing up the atmospheric valve by the contact member formed at the liquid ejecting apparatus via the film. Due to this, the atmospheric valve is arranged at the upper part in regard to the ink cartridge, so it is possible to increase the capacity of keeping the liquid.

In the liquid cartridge, a flexure may be provided at the film in order that the contact member of the liquid ejecting apparatus can push up the atmospheric valve pushing member via the film until the atmospheric valve opens the communicating hole. Due to this, when the contact member of the liquid ejecting apparatus pushes up the atmospheric valve via the film, it is possible to prevent the film from being expanded and broken.

The liquid cartridge may further comprise a seal film for blocking between the liquid accommodating section and the communicating hole, and a tearing means for tearing the seal film when the liquid cartridge is mounted on the liquid ejecting apparatus. Due to this, it is possible to prevent the liquid from leaking out toward the atmospheric valve by the communicating hole out of use.

The liquid cartridge may further comprise an attaching part on which a memory is attached, of which a side face is positioned by the liquid ejecting apparatus, wherein the atmospheric valve may be arranged near the attaching part. Due to this, it is possible to exactly positioning the atmospheric valve and the contact member and to securely perform atmosphere opening.

According to the second aspect of the present invention, a liquid cartridge mounted while being in contact with a part of a liquid ejecting apparatus and turning around the liquid ejecting apparatus, comprises a liquid accommodating section for containing a liquid, a liquid supplying part, which communicates with the liquid accommodating section and has a supply valve pushed up by a liquid supplying needle when the liquid supplying needle of the liquid ejecting apparatus is inserted and an atmospheric valve for sealing a communicating hole which allows the liquid accommodating section to communicate with atmosphere, while opening the communicating hole by being moved by a contact member formed at the liquid ejecting apparatus in a direction substantially parallel to a direction, in which the liquid supplying needle is inserted into the liquid supplying part, when the liquid ejecting apparatus is mounted, wherein an angle, by which the liquid cartridge turns around the liquid ejecting apparatus in order that the atmospheric valve is in contact with the contact member of the liquid ejecting apparatus taking a point at which the liquid cartridge turns around the liquid ejecting apparatus as an axis, is smaller than an angle, by which the liquid cartridge turns around the liquid ejecting apparatus taking the point as an axis in order that the supply valve is in contact with the liquid supplying needle.

Due to this, when the liquid cartridge is mounted onto the liquid ejecting apparatus, it is possible to open the atmospheric valve before the liquid supplying needle is inserted into liquid supplying part, and to prevent the ink flowing from the liquid ejecting apparatus to the liquid cartridge when the pressure inside the liquid cartridge is smaller than that inside the liquid ejecting apparatus. Particularly, when the liquid cartridge is mounted, the meniscus formed at the nozzle of the liquid ejecting head might be led in toward the head by the pressure inside the liquid cartridge (the pressure lower than the atmosphere pressure), and also the bad ejection of the head might happen because the bubbles are intruded into the head from the nozzle, but it is possible to prevent those according to the configuration above.

According to the third aspect of the present invention, a liquid cartridge mounted while being in contact with a part of a liquid ejecting apparatus and turning around the liquid ejecting apparatus, comprises a liquid accommodating section for containing a liquid, a liquid supplying part, which communicates with the liquid accommodating section and a liquid supplying needle of the liquid ejecting apparatus is inserted into and an atmospheric valve for sealing a communicating hole which allows the liquid accommodating section to communicate with atmosphere, while opening the communicating hole by being moved by a contact member formed at the liquid ejecting apparatus in a direction substantially parallel to a direction, in which the liquid supplying needle is inserted into the liquid supplying part, when the liquid ejecting apparatus is mounted, wherein a contact part between the atmospheric valve and the contact member is provided at a position more closer to a point, at which the liquid cartridge turns around the liquid ejecting apparatus, than the liquid supplying part.

Due to this, when the liquid cartridge is mounted onto the liquid ejecting apparatus, it is possible to open the atmospheric valve before the liquid supplying needle is inserted into liquid supplying part, and to prevent the ink flowing from the liquid ejecting apparatus to the liquid cartridge when the pressure inside the liquid cartridge is smaller than that inside the liquid ejecting apparatus. Particularly, when the liquid cartridge is mounted, the meniscus formed at the nozzle of the liquid ejecting head might be led in toward the head by the pressure inside the liquid cartridge (the pressure lower than the atmosphere pressure), and also the bad ejection of the head might happen because the bubbles are intruded into the head from the nozzle, but it is possible to prevent those according to the configuration above.

The liquid cartridge may further comprise a check valve, which is provided between the liquid accommodating section and the communicating hole, for allowing atmosphere to flow from the communicating hole to the liquid accommodating section, and for inhibiting a liquid flowing from the liquid accommodating section to the communicating hole.

Due to this, although the atmospheric valve is opened before the liquid supplying needle is inserted into the liquid supplying part, it is possible to securely prevent the liquid from flowing out toward the atmospheric valve.

The summary of the invention does not necessarily describe all necessary features of the present invention. The present invention may also be a sub-combination of the features described above. The above and other features and advantages of the present invention will become more apparent from the following description of the embodiments taken in conjunction with the accompanying drawings.

DETAILED DESCRIPTION OF THE INVENTION

The invention will now be described based on the preferred embodiments, which do not intend to limit the scope of the present invention, but exemplify the invention. All of the features and the combinations thereof described in the embodiment are not necessarily essential to the invention.

Figure 1:
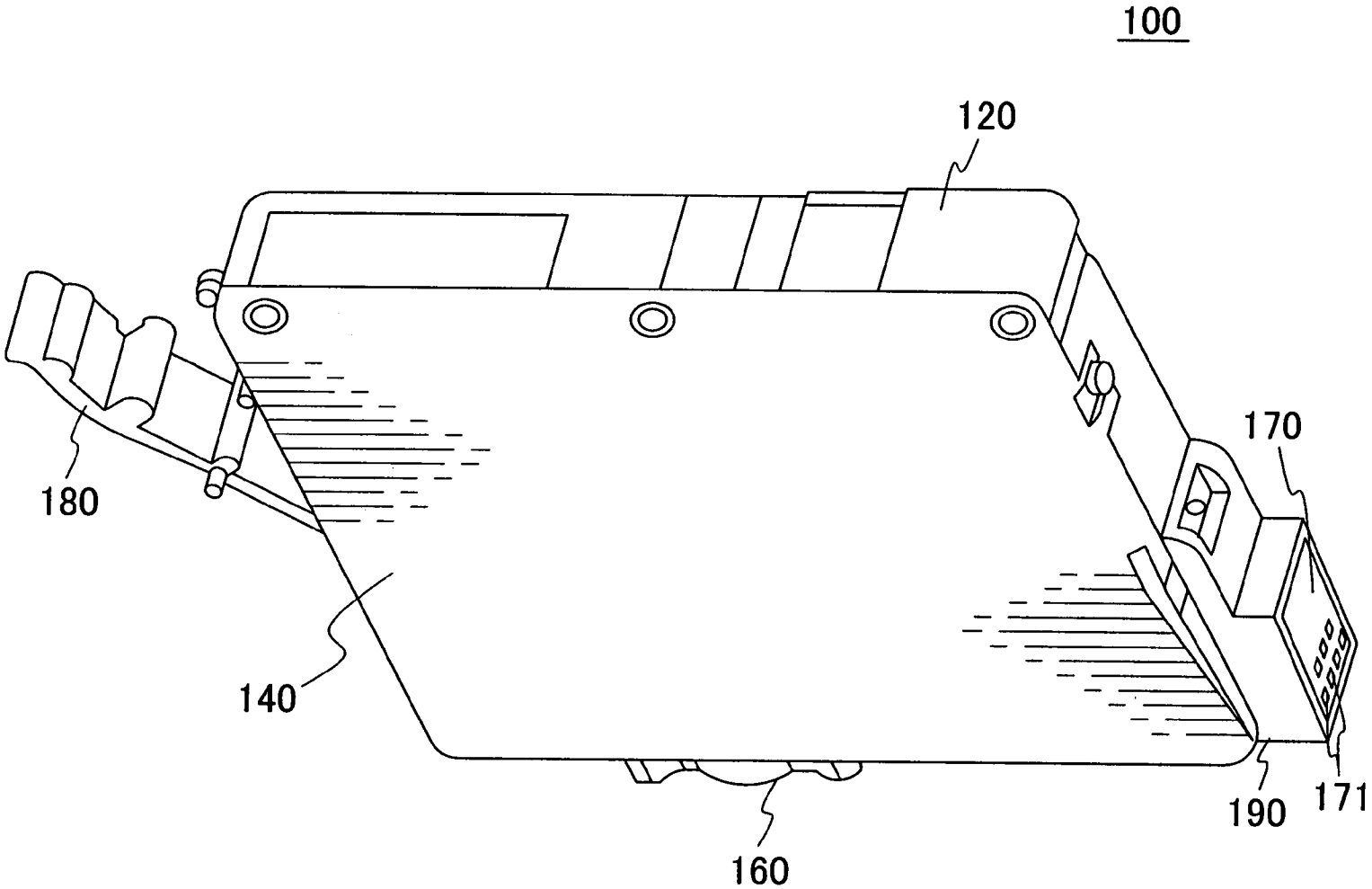
FIG. 1 is a front perspective view of an ink cartridge 100 according to a first embodiment.

FIG. 1 is a front perspective view of the structure of the ink cartridge 100 for use in an inkjet type recording apparatus, which is adapted for an example of a liquid cartridge suitable for supplying a liquid to a liquid ejecting head of a liquid ejecting apparatus, obliquely viewed from an upper position.

In addition, the liquid ejecting apparatus of the present invention is not limited to the liquid ejecting head of the liquid ejecting apparatus, and it includes a color material ejecting head of the color filter manufacturing apparatus for manufacturing color filters of a liquid crystal display, an electrode material (conduction paste) ejecting head for forming electrodes such as an organic EL display or a FED (Field Emission Display) and further a bio organism ejecting head of the bio-chip manufacturing apparatus and a sample ejecting head as a minute pipette for manufacturing bio-chips.

Figure 2:
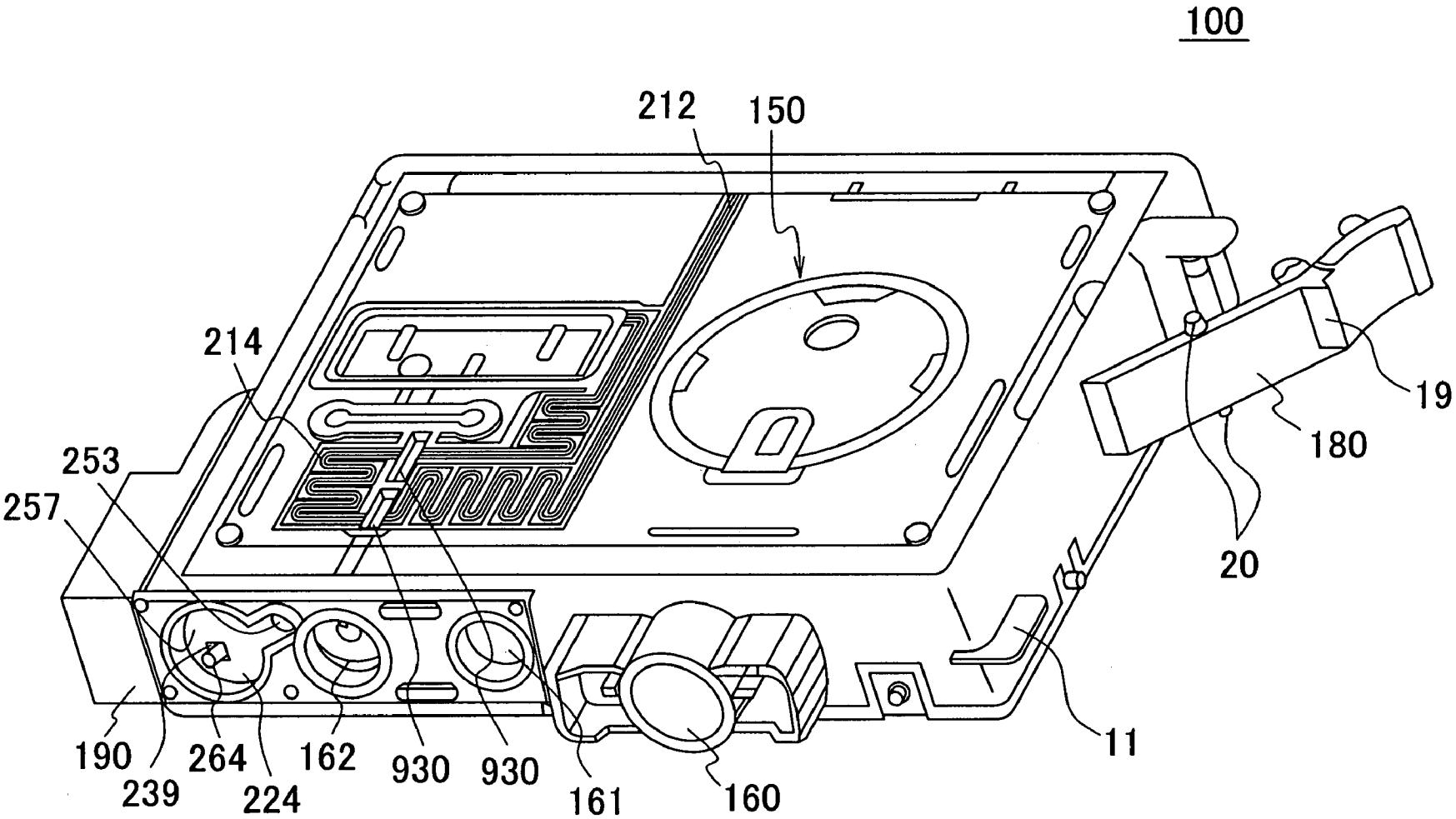
FIG. 2 is a rear perspective view of an ink cartridge 100 before a film 110 is attached.
Figure 3:
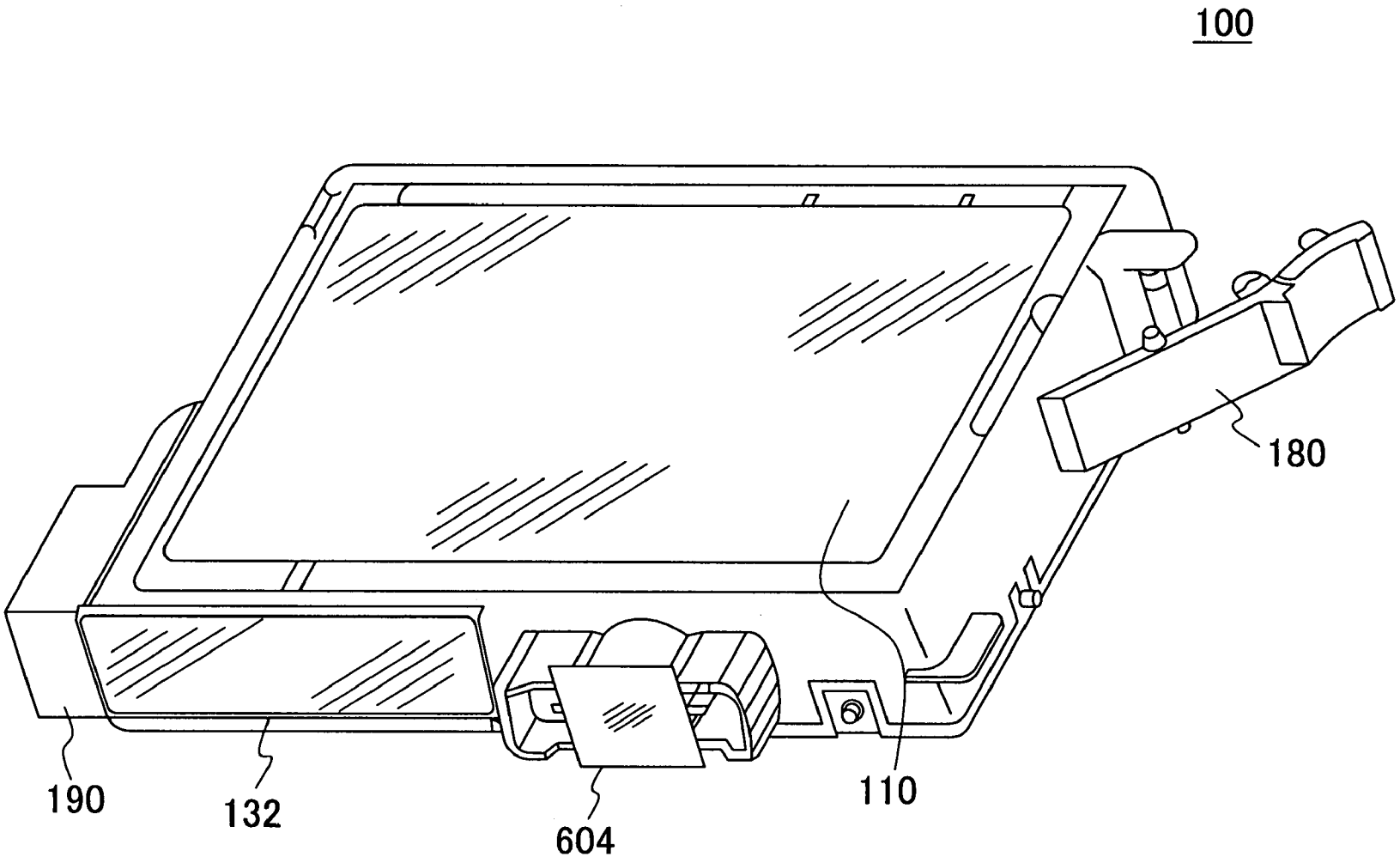
FIG. 3 is a rear perspective view of an ink cartridge 100 after a film 110 is attached.
Figure 4:
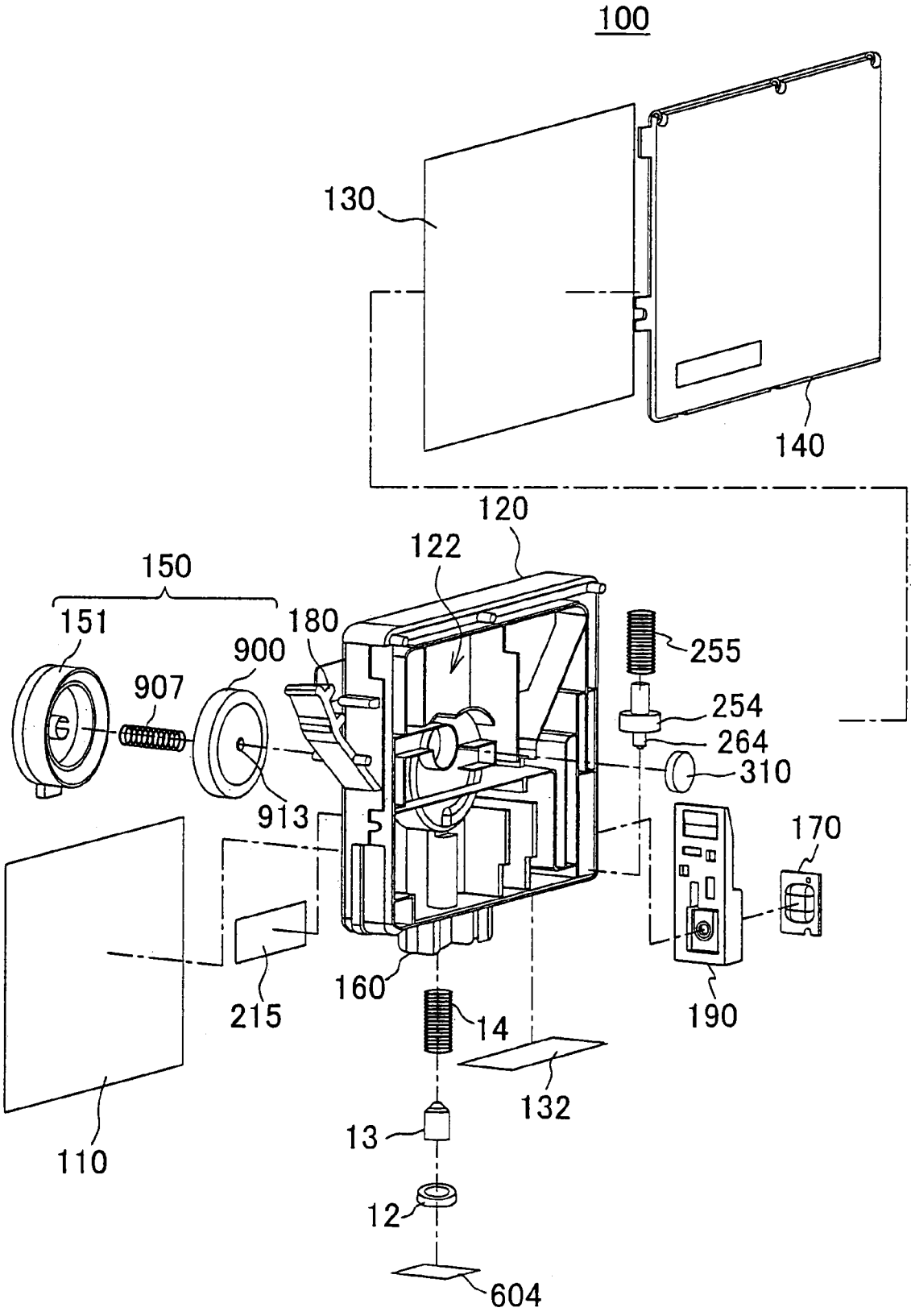
FIG. 4 is an exploded perspective view of an ink cartridge 100.
Figure 5:
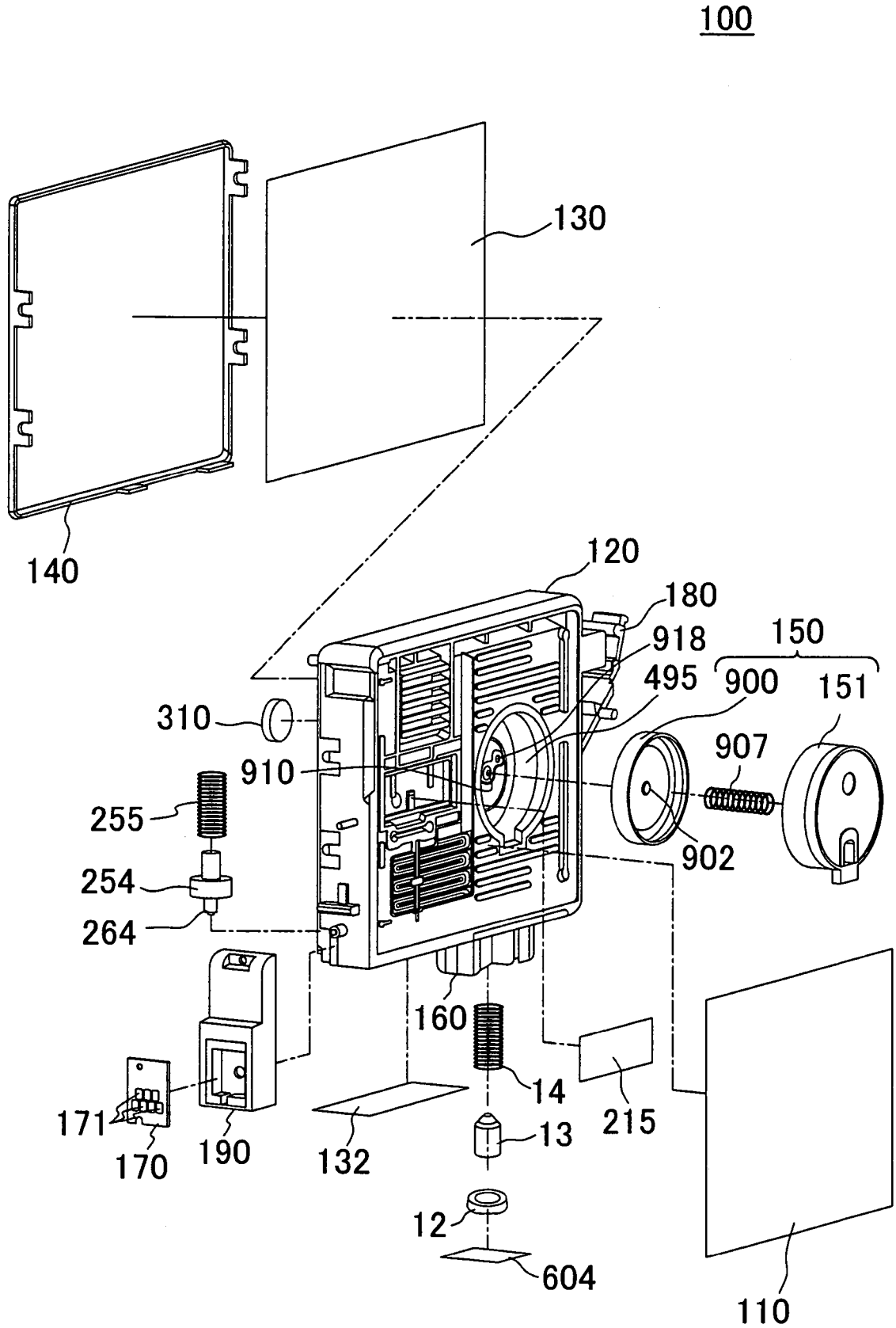
FIG. 5 is an exploded perspective view of an ink cartridge 100.
Figure 6:
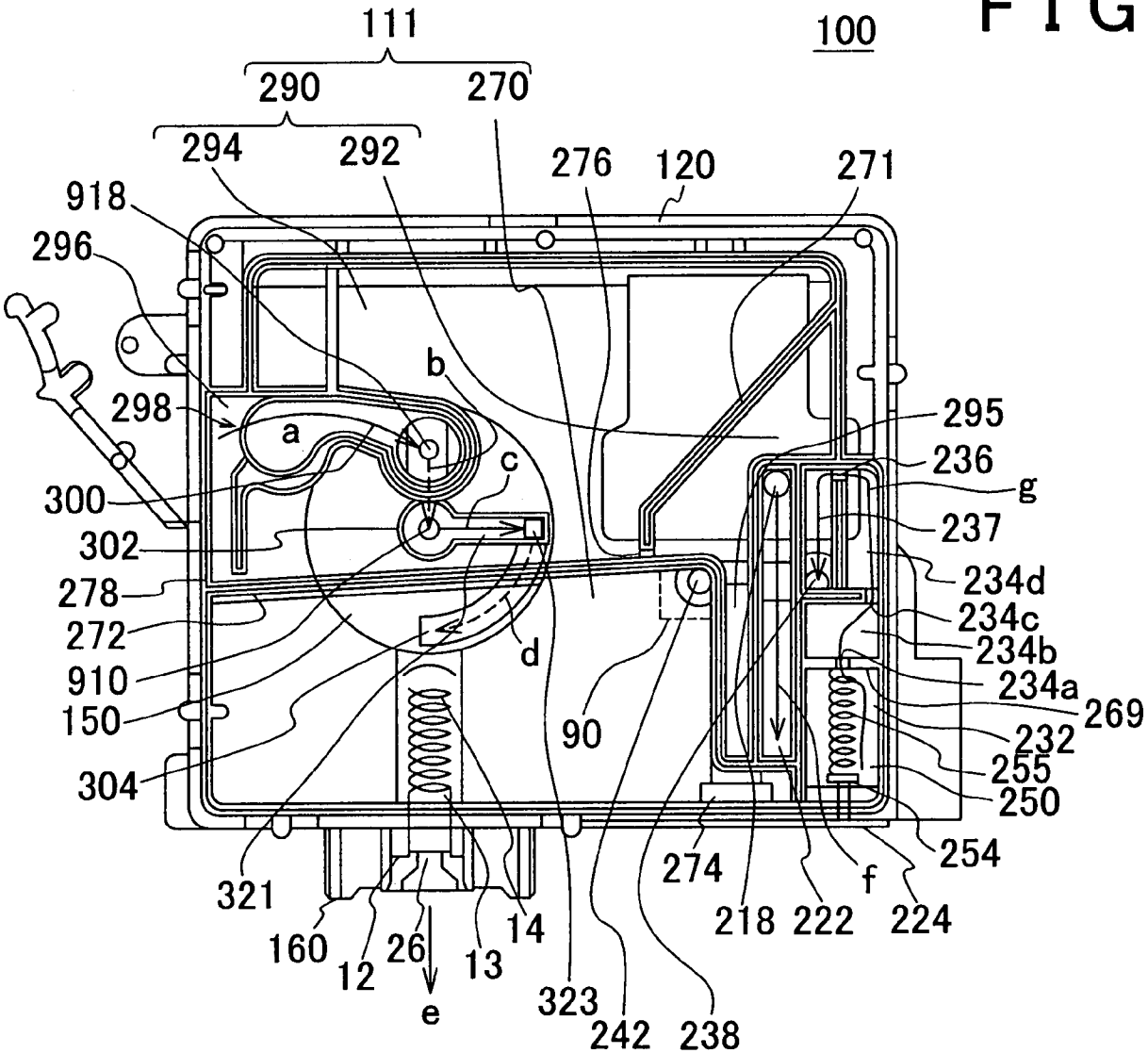
FIG. 6 is a front view of an ink cartridge 100 in a state before a film 130 is attached.
Figure 7:
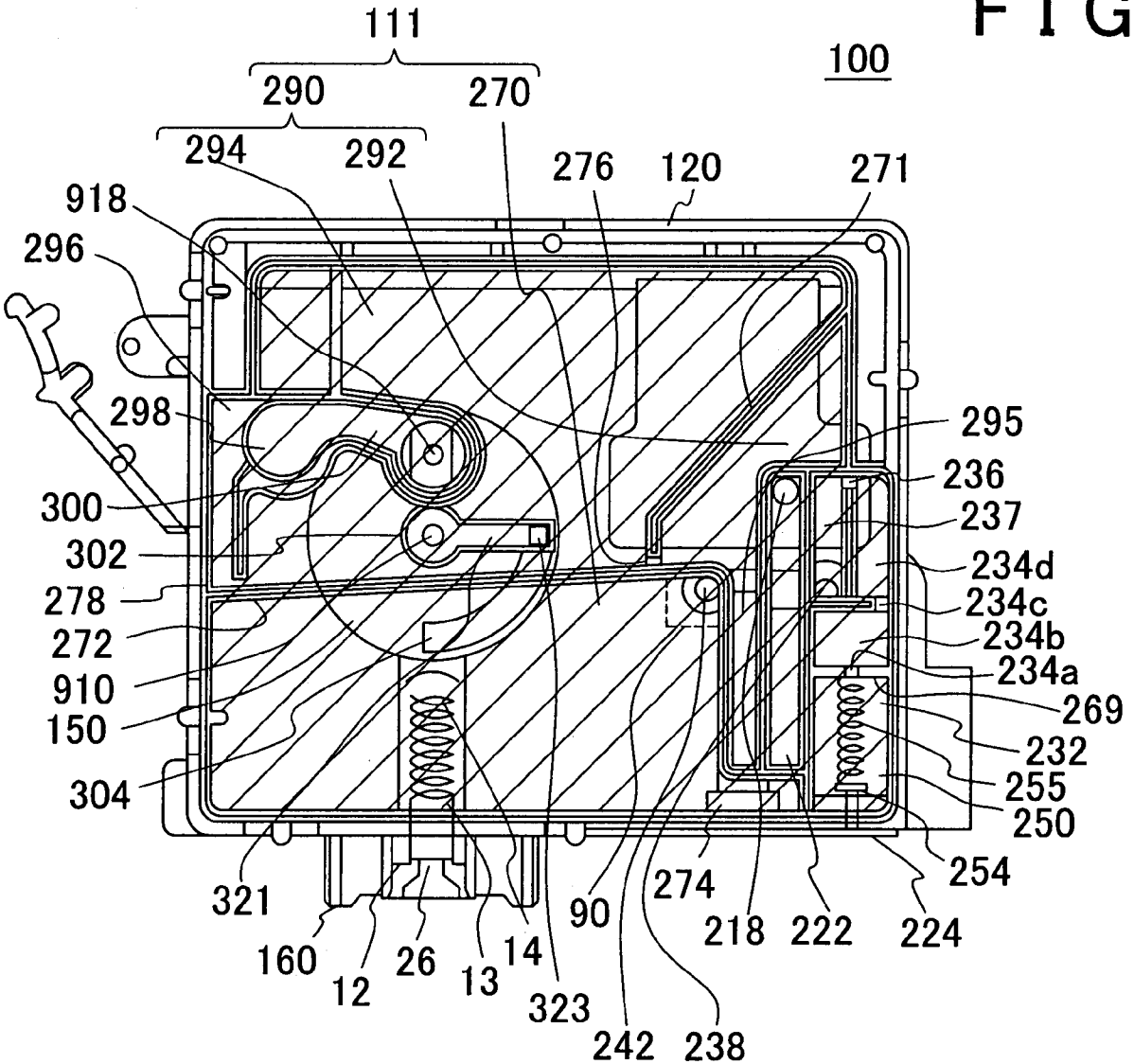
FIG. 7 is a front view of an ink cartridge 100 in a state after a film 130 is attached.

FIG. 2 and FIG. 3 are rear perspective views the ink cartridge 100 in FIG. 1 obliquely viewed from a lower position, FIG. 2 shows the ink cartridge 100 in a state a film 110 is not attached thereto and FIG. 3 shows the ink cartridge 100 in a state the film 110 is attached thereto. Further, FIG. 4 and FIG. 5 are perspective views showing the ink cartridge 100 wherein members of which the ink cartridge 100 consist is exploded. FIG. 6 and FIG. 7 are front views of the ink cartridge 100 in FIG. 1, FIG. 6 shows the ink cartridge 100 in a state before a film 130 is attached to an opening part 122 of the ink cartridge 100 and FIG. 7 shows the ink cartridge 100 in a state in which a film 130 is attached to an opening part 122 of the ink cartridge 100. In addition, the film 130 is attached to an area, which is shown with hatching in FIG. 7.

As shown in FIG. 4, the ink cartridge 100 has a cartridge body 120 having a shape of an approximate case with the opening part 122, the film 130, which covers almost all face of the opening part 122 and a lid 140, which covers the outside of the film 130. The internal part of the cartridge body 120 is partitioned by ribs or walls as described below. The film 130 seals almost all face of the opening part 122 of the cartridge body 120 in order that the internal part of it comes into a closed state. The lid 140 is further fixed to the cartridge body 120 in order to wrap the outside of the film 130 in a non-closed state.

The cartridge body 120 has an ink accommodating section 111 for containing ink, an ink channel part from the ink accommodating section 111 to an ink supplying part 160, an ink side passage, which allows the ink accommodating section 111 to communicate with the atmosphere, the atmospheric valve accommodating section and an atmosphere communicating part, which consists of an atmosphere passage, and it is made of, for example, Polypropylene (PP) in a unified body.

The ink cartridge 100 further has an ink supply controlling means 150, a memory 170 and an engaging lever 180. The ink supplying part 160 supplies ink, which is contained in the ink accommodating section 111, to the recording head of the inkjet type recording apparatus through an ink supply needle of the apparatus which needle is inserted into an opening of said ink supplying part 160. The ink supply needle faces the lower face of the cartridge body 120 and is formed on the carriage 42 mounting thereon the ink cartridge 100. The memory 170 is caulked into an attaching part 190 and the attaching part is caulked and attached to the lower part of the side face of the cartridge body 120. The memory 170 stores the information on the kind of the ink cartridge 100, the information on the color held by the ink cartridge 100 and the information on the present amount of remaining ink etc., and it transfers this information by a plurality of terminals 171, which are exposed thereon, between the apparatus body and the ink cartridge 100. The engaging lever 180 is formed at the upper part of the side face opposite to the attaching part 190 in regard to the cartridge body 120, and is engaged with the carriage 42 of the inkjet type recording apparatus. The side face of the attaching part 190 is controlled by a rib not shown in the drawing, which is formed at the carriage, and thus the terminals 171 and elastic contact points of the carriage side are designed to be in contact with each other securely.

An ink supply controlling means 150 consists of a differential pressure valve, which supplies ink of the ink accommodating section 111 to the ink supplying part 160 by pressure difference between ink accommodating section 111 and the ink supplying part 160 that occurs accompanying the consummation of ink. The ink supply controlling means has a membrane valve 900, which is an example of a valve member inserted into a concave part 495 of the cartridge body 120, capable of elastic deformation, a valve lid 151 which covers the concave part 495, a coil spring 907 which is an example of an urging member arranged between the membrane valve 900 and the valve lid 151.

The ink accommodating section 111 is divided by a wall 272 mainly into a upper part and a lower part, which extends in a horizontal direction, as shown in FIG. 6 and FIG. 7, and an atmosphere side accommodating section 270, which can communicate with the atmosphere by a communicating hole 242, is formed in the lower part, while a supply side accommodating section, which consists of a first ink accommodating section 292 and a second ink accommodating section 294 and is blocked from the atmosphere, is formed in the upper part. The supply side accommodating section 290 is divided by a slope wall 271 having a communicating part 276 near the wall 272 (at the lower part area) into the first and second ink accommodating sections 292 and 294, and is provided with a channel part 296, which is arranged in order to surround the circumference of the second ink accommodating section 294. The channel part 296 is coupled with the second ink accommodating section 294 via a communicating part 278 at the lower part, and besides is coupled with the ink supply controlling means 150 via passages 298 and 300 and a passage hole 918.

Moreover, the lower flow side of the ink supply controlling means 150 is configured to communicate with the ink supplying part 160 via a passage hole 910 which communicates with the ink supply controlling means 150, a communicating part 302 and a channel 321 which communicate with the passage hole 910, a passage hole 323 which is formed at an end of the channel 321 and is formed to face the front face side and a communicating part 304 of which an end communicates with the passage hole 323.

The atmosphere side accommodating section 270 and the first ink accommodating section 292 communicate with each other by a communicating passage 295 which extends vertically, and are configured in order that the ink in the atmosphere side accommodating section 270 is sucked up into the first ink accommodating section 292 corresponding to the consummation of ink from the ink supplying part 160 and then flows into the ink supply controlling means 150 via the second ink accommodating section 294 and the channel part 296 etc. The ink flows into the ink supply controlling means 150 from the atmosphere side accommodating section 270 of the ink accommodating section 111 through a sequence of the communicating part 274, a second ink inlet 162, a communicating passage 295, the communicating parts 276 and 278, the channel part 296, the passages 298 and 300 and the passage hole 918.

Meanwhile, the atmospheric valve part 250 has an atmospheric valve accommodating section 232, which is hollow therein, for containing an atmospheric valve 254, and has a communicating hole 239, also serving as a atmosphere communicating channel, of which the diameter is a little larger than that of a shaft part 264 of the atmospheric valve 254, on the wall face of a lower position of the atmospheric valve accommodating section 232, so that the shaft part 264 of the atmospheric valve 254 is always urged towards the bottom face of the ink cartridge 100 by a spring 255 and inserted thereto to be able to freely slide, and the communicating hole 239 is sealed by the atmospheric valve 254 when the ink cartridge 100 is not mounted onto the carriage 42 of the inkjet type recording apparatus. Owing to this, the atmospheric valve 254 is arranged to be capable of moving in a vertical direction in which the ink cartridge 100 is mounted on the carriage 42, and opens the communicating hole 239 by being pressed upward by a contact member 60 as an example of a contact member formed in carriage when mounted on the carriage 42.

Figure 8:
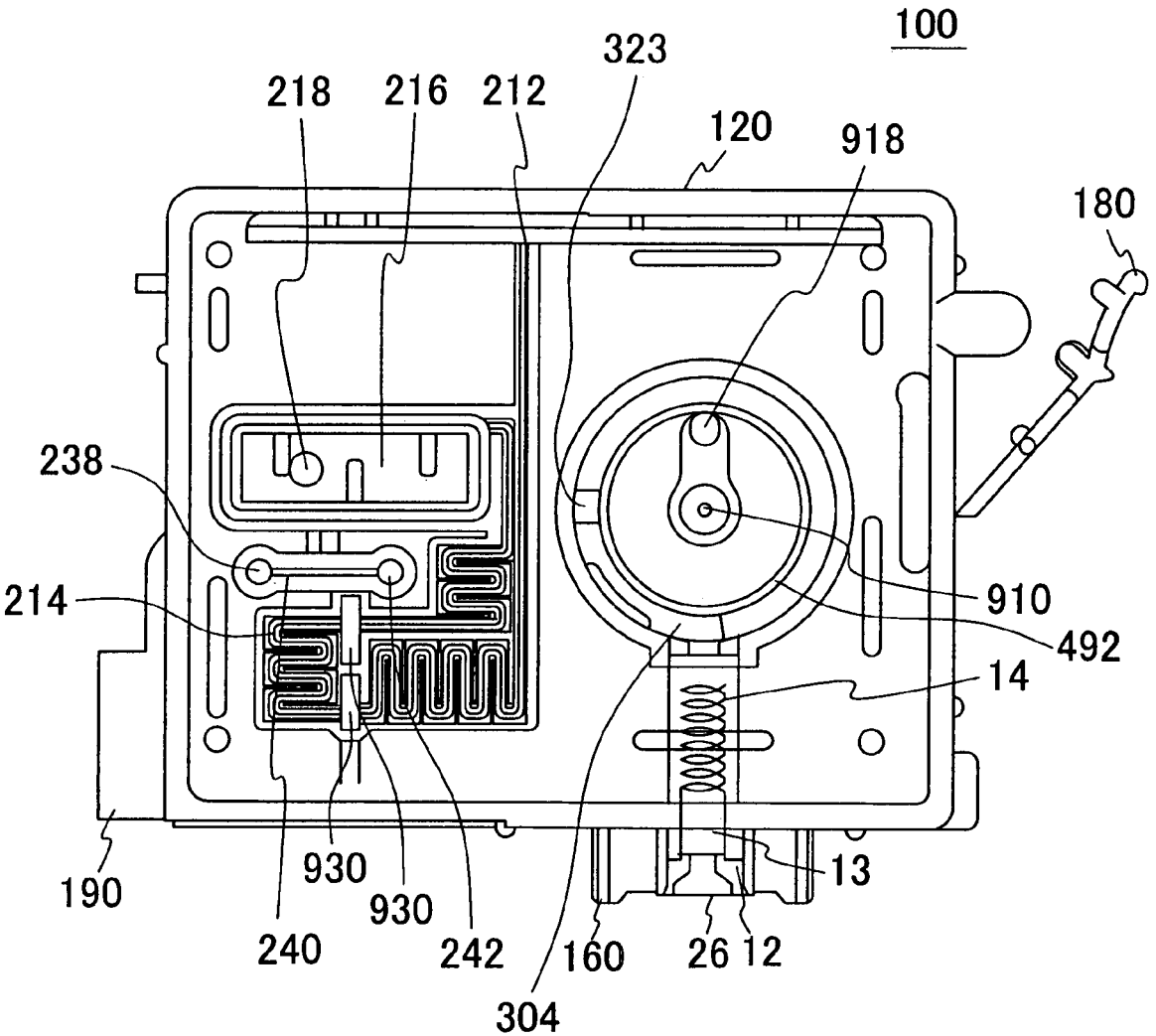
FIG. 8 is a rear view of an ink cartridge 100 in a state before a film 110 is attached.

FIG. 8 is a rear view showing the ink cartridge 100 of FIG. 1 in a state before the film 110 is attached thereto. The atmosphere side passage, which communicates with the atmosphere taking the communicating hole 239 described above as a boundary, consists of an opening 212, a passage 214 which is circuitous or winding, a filter accommodating section 216, a communicating hole 218, a communicating part 222 and a communicating hole 253 and a communicating part 224 which are formed on the bottom face of the communicating part 222.

Particularly, as shown in FIG. 8, an end of one passage 214, which is formed on the front face of the cartridge body 120 and winding in the shape of a maze, is opened with the atmosphere by the opening 212, and the other end is coupled with the filter accommodating section 216 for containing the filter 215 (FIG. 4 and FIG. 5) having a function of ink repellency and air permeability. The filter container part 216 communicates with the communicating hole 218, which penetrates from the front side to the rear side of the cartridge body 120. The communicating hole 218 is coupled with the communicating part 224 via the communicating part 222 and the communicating hole 253, which is formed on the bottom part of a room that partitions the communicating part 222, in the rear side of the cartridge body 120. In the middle of the passage 214, a chamber 930, which consists of a concave part, is provided.

As shown in FIG. 2, the communicating part 224 is formed as a concave part 257 on the bottom face of the cartridge body 120, and a shaft part 264, which serves as an operating rod of the atmospheric valve 254, is exposed, while the communicating hole 239 capable of communicating with the atmospheric valve accommodating section 232, which contains the atmospheric valve 254, and the communicating hole 253, which communicates with the communicating part 222, are formed inside the concave part 257, and the external face of the concave part 257 is sealed by the film 132 for sealing the first and second ink inlets 161 and 162. A thing, which performs elastic deformation by a pressing force of a projection protruding from the carriage 42, may be chosen for this film 132.

Meanwhile, as shown in FIG. 6, the ink side passage, which communicates with the atmosphere side accommodating section 270 taking the communicating hole 239 described above as a boundary, consists of an atmospheric valve accommodating section 232, a passage hole **234*a*, a communicating chamber 234*b*, a communicating part 234*c*, a communicating chamber 234*d*, a communicating part 236, a communicating chamber 237 and a communicating hole 238, a communicating groove 240 and a communicating hole 242. Particularly, the passage hole 234***a* is formed on a wall of upper part of the atmospheric valve accommodating section 232, and the atmosphere passage is formed to communicate in the following sequence: the communicating chamber 234*b* via the passage hole 234*a*, the communicating part 234*c* formed by a notch on a wall of the upper part of the communicating chamber 234*b*, the communicating chamber 234*d* provided at the upper part of the communicating part 234*c*, the communicating part 236 formed by a notch of a wall of the upper part of the communicating chamber 234*d* and the communicating chamber 237 provided with the communicating hole 238 at a lower position.

The communicating hole 238, which penetrates from the rear side to front side of the cartridge body 120, communicates with the atmosphere side accommodating section 270 via the communicating groove 240, which communicates with the communicating hole 238, and the communicating hole 242, which communicates with the communicating groove 240 and also penetrates from the front side to the rear side of the cartridge body 120.

These the atmosphere side accommodating section 270, the supply side accommodating section 290, the atmospheric valve part 250 and the atmosphere side passage and the ink side passage become an area which is separated from the atmosphere by attaching the films 130 and 110 to the wall partitioning each of those by thermo welding.

The ink supplying part 160 has a seal member 12, which is made of elastomer having an insertion opening 26 into which the ink supply needle provided in the carriage 42 is inserted, a supply valve 13, which closes the insertion opening 26 of the seal member 12 and an urging member, which consists of a coil spring etc. that urges the supply valve 13 towards the seal member 12. In addition, a film 604 is attached to the insertion opening 26 of the seal member 12 at the time of factory.

When the ink cartridge 100 is mounted on the carriage 42 of the inkjet type recording apparatus, the projecting part provided in the carriage 42 pushes up the shaft part 264 of the atmospheric valve upwardly via the film 132 and the ink supply needle of the carriage 42 pushes up the supply valve 13 of the ink supplying part 160 upwardly. Due to this, the communicating hole 239 allows the atmosphere channel, extending from the atmospheric valve accommodating section 232 to the communicating hole 242, to communicate with the atmosphere. And, the upper flow than the supply valve 13 in regard to the ink supplying part 160 communicates with the ink supply needle.

When the inkjet type recording apparatus is operated to record in a state where the communicating hole 242 communicates with the atmosphere, the recording head is supplied with ink through the ink supply needle from the ink supplying part 160. When ink is supplied from the ink supplying part 160, the ink, which flows in a sequence of an arrow a shown in FIG. 6 and the passage hole 918 in the ink accommodating section 111, flows in a sequence of arrows b, c and d shown in FIG. 6 via the ink supply controlling means 150, flows into the ink supplying part 160 and is supplied to the ink supply needle inserted in the ink supplying part 160.

According to this flow of ink, in the ink accommodating section 111, the ink of the atmosphere side accommodating section 270 is supplied to the supply side accommodating section 290. The atmosphere accompanying the consummation of ink in the atmosphere side accommodating section 270 flows into the atmosphere side accommodating section 270 from the communicating hole 242 through a route in a sequence of an arrow f in FIG. 6, the communicating part 224 of the bottom face and an arrow g. Although the liquid level of the atmosphere side accommodating section 270 goes down because ink is provided to the recording head from the ink supplying part 160, the channel, which is coupled with the atmosphere side accommodating section 270 and the supply side accommodating section 290, is provided with a communicating opening at the lowest part of the atmosphere side accommodating section 270, so that the atmosphere is not flowed into the supply side accommodating section 290 until all of the ink in the atmosphere side accommodating section 270 is moved to the supply side accommodating section.

After the ink in the atmosphere side accommodating section 270 is completely consumed, the ink in the first and second ink accommodating sections 292 and 294 of the supply side accommodating section 290 is consumed in that sequence. During that time, due to the surface tension caused by the meniscus of ink formed in the second ink inlet 162, which communicates with the supply side accommodating section 290 and the atmosphere side accommodating section 270, the ink in the supply side accommodating section 290 is prevented from being flowed backward to the atmosphere side accommodating section 270.

When the ink in the first ink accommodating section 292 begins to be consumed, the air flows into the first ink accommodating section 292. Due to this, the liquid level of the first ink accommodating section 292 goes down, but the first and second ink accommodating sections 292 and 294 communicate by the communicating part 276 only at the lower part, so that the ink in the first ink accommodating section 292 is first consumed. When the liquid level reaches the communicating part 276 because the ink in the first ink accommodating section 292 is consumed, the air flows into the second ink accommodating section 294 according to the consummation of ink in the second ink accommodating section 294. While the ink in the second ink accommodating section is consumed, the surface tension caused by the meniscus of ink in the communicating part 276 occurs, and therefore the ink in the second ink accommodating section 294 is prevented from being flowed backward to the first ink accommodating section 292.

As described above, although the ink in the atmosphere side accommodating section 270 and the first and second ink accommodating sections 292 and 294 is consumed in that sequence, the ink is supplied into the ink supplying part 160 through the passage hole 918 via the passage 300 from the communicating part 278, which is provided near the wall 272 that partitions the ink accommodating section into nearly two parts up and down, even though the liquid level of ink exists in any accommodating section.

As shown in FIG. 6, the communicating hole 242 may be provided with a check valve 90 for inhibiting the ink from transferring from the atmosphere side accommodating section 270 to the communicating hole 242 by allowing the atmosphere to transfer from the communicating hole 242 to the atmosphere side accommodating section 270. An example of the check valve 90 is a film valve. In this case, an edge of the film in the shape of a rectangle is attached in order to cover the communicating hole 242 from the atmosphere side accommodating section 270 side, and the other three edges are designed to be capable of moving freely. Due to this, it is possible to prevent the ink from leaking out from the ink accommodating section 111 to the communicating part 242.

Figure 9:
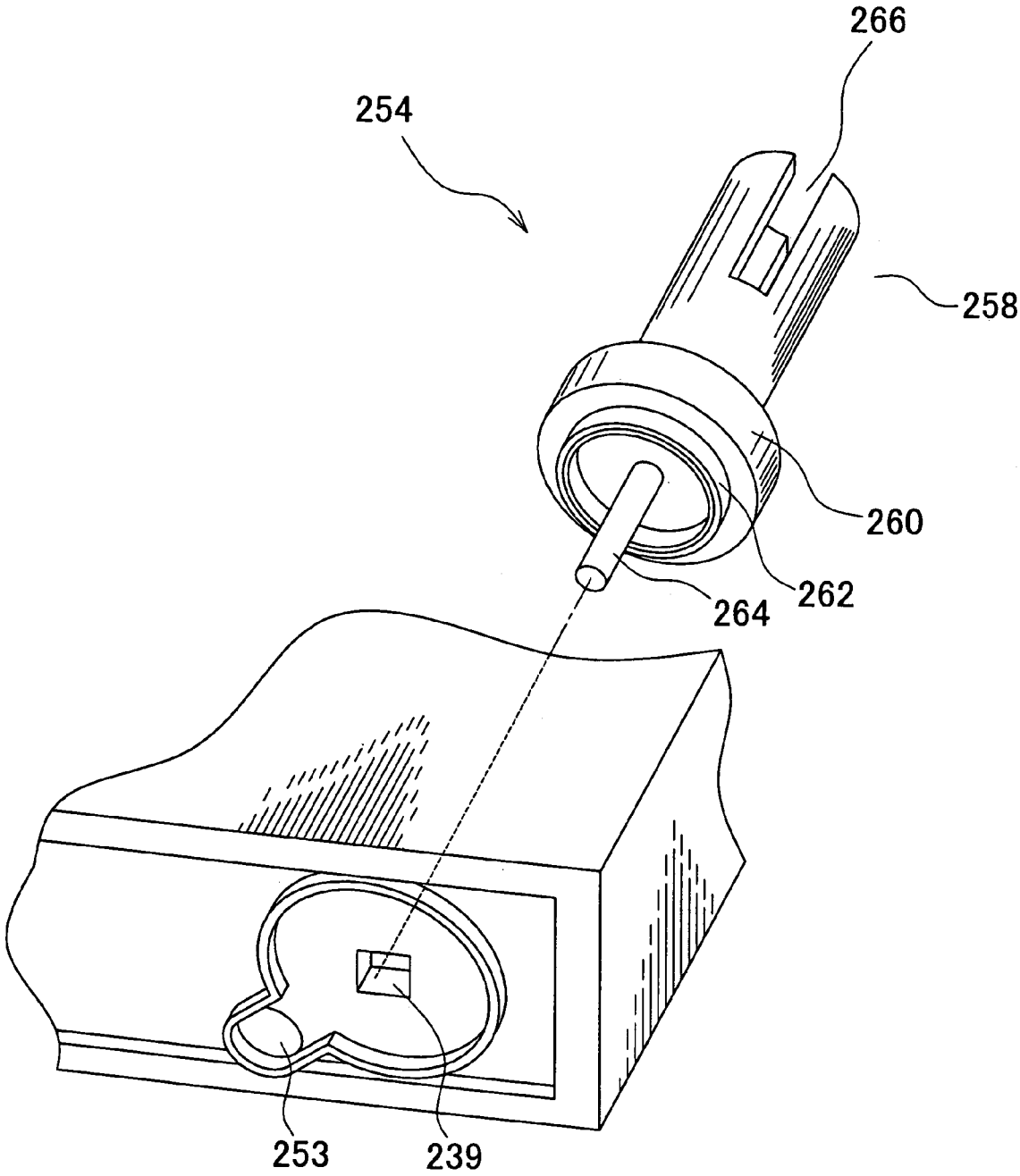
FIG. 9 is an exploded perspective view that shows an atmospheric valve 254 and the communicating hole 239.

FIG. 9 is an exploded perspective view of that shows the surrounding of the atmospheric valve and the communicating hole 239 of the cartridge body 120. The atmospheric valve 254 has a guide part 258, which is of substantially cylindrical shape onto which a coil spring 255 is inserted, a disc part 260, which is provided at an end of one side of the guide part 258, a seal part 262, which protrudes in the shape of a ring toward the opposite side of the guide part 258 at the disc part 260 and a shaft part 264, which extends from the center of the disc part 260 toward the opposite side of the guide part 258. The guide part 258 is provided with a notched part 266, which is cut in from the side where it is inserted into a coil spring 255. The disc part 260 has the shape of a disc of which the diameter is longer than the guide part 258, and is urged by the coil spring to seal the surrounding of the communicating hole 239. The seal part 262, which is an example of a sealing part relating to the present invention, protrudes in the shape of a ring in order to surround the external side of the communicating part 239 of a rectangle in shape. In the present embodiment, an end of the seal part 262 in the shape of a ring protrudes inwardly and outwardly twice (the cross-sectional view is "M" in shape), and due to this the sealing force becomes high. The shaft part 264 is of substantially cylindrical shape with diameter, which approximately touches the communicating hole 239 of a rectangle in shape internally, and extends more than the seal part 262. The atmospheric valve 254 except the seal part 262 is molded with, e.g., Polypropylene, and the seal part 262 is molded with, e.g., elastomer. These are integrally molded by a dichroic molding. However, the configuration of the seal part 262 is not limited to this, and the seal part 262 may be formed as an O-ring separate from the atmospheric valve 254.

It will be described how to contain the atmospheric valve 254 in the atmospheric valve accommodating section or chamber 232 of the cartridge body 120 hereinafter. First, the guide part 258 of the atmospheric valve 254 is inserted into the coil spring 255, and a first end of the coil spring 255 is in contact with the disc part 260. A second end of the coil spring 255 is pressed downward by a fixture, and the coil spring 255 is contracted until it is shorter than the guide part 258. At this situation, an assembly fixture is inserted into the notched part 266, and the coil spring 255 and the atmospheric valve 254 are temporarily stopped at the fixture. The coil spring 255 and the atmospheric valve 254 temporarily stopped by the fixture is contained in the atmospheric valve accommodating chamber 232 by inserting the shaft part 264 of the atmospheric valve 254 into the communicating hole 239.

At the situation wherein the shaft part 264 of the atmospheric valve 254 is inserted into the communicating hole 239, the assembly fixture is removed from the notched part 266. Due to this, the coil spring 255 is released, and it is held between the disc part 260 of the atmospheric valve 254 and a wall part 269 of the atmospheric valve accommodating chamber 232. Therefore, the coil spring 255 urges the atmospheric valve 254 towards the communicating part 239 for sealing the communicating part 239. Since the atmospheric valve 254 is urged by the coil spring 255, the seal part 262 seals and covers the communicating part 239, and the ink accommodating section 111 is blocked from the atmosphere.

As described above, since the assembly fixture can be inserted into the notched part 266 in the state wherein the guide part 258 of the atmospheric valve 254 is inserted into the coil spring 255, it is possible to easily insert the atmospheric valve 254 and the coil spring 255 into the ink cartridge 100. In addition, the stroke of the coil spring 255, which is contracted, can be increased, so that it is possible to urge the atmospheric valve 254 towards a direction to seal the communicating part 239 with a large urging force in comparison to using a leaf spring.

And, as shown in FIG. 9, the shaft part 264 has a circular cross-section and the communicating hole 239 is an approximate rectangle in shape, and thus the shaft part 264 of the atmospheric valve 254 touches the communicating hole 239 internally at four points. Due to this, the position of the atmospheric valve 254 is exactly determined at the state without looseness to the communicating hole 239. Further, since there is a passage of air between the points at which the communicating hole 239 and the shaft part 264 are in contact with each other, it is possible to reduce the passage resistance against the atmosphere that flows through the communicating part 239, when the seal part 262 opens the communicating part 239.

Figure 10:
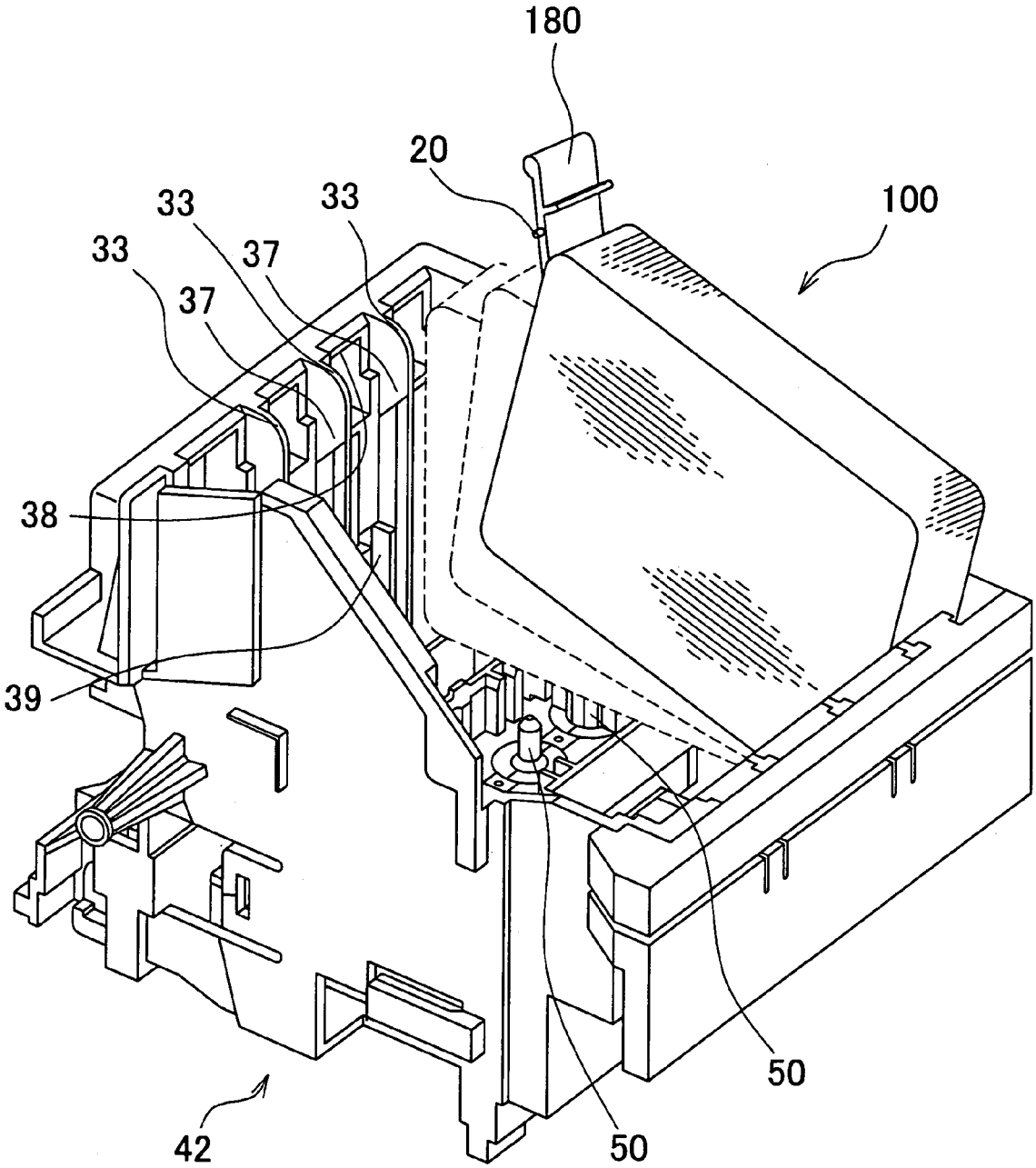
FIG. 10 is a perspective view of a carriage 42.
Figure 11:
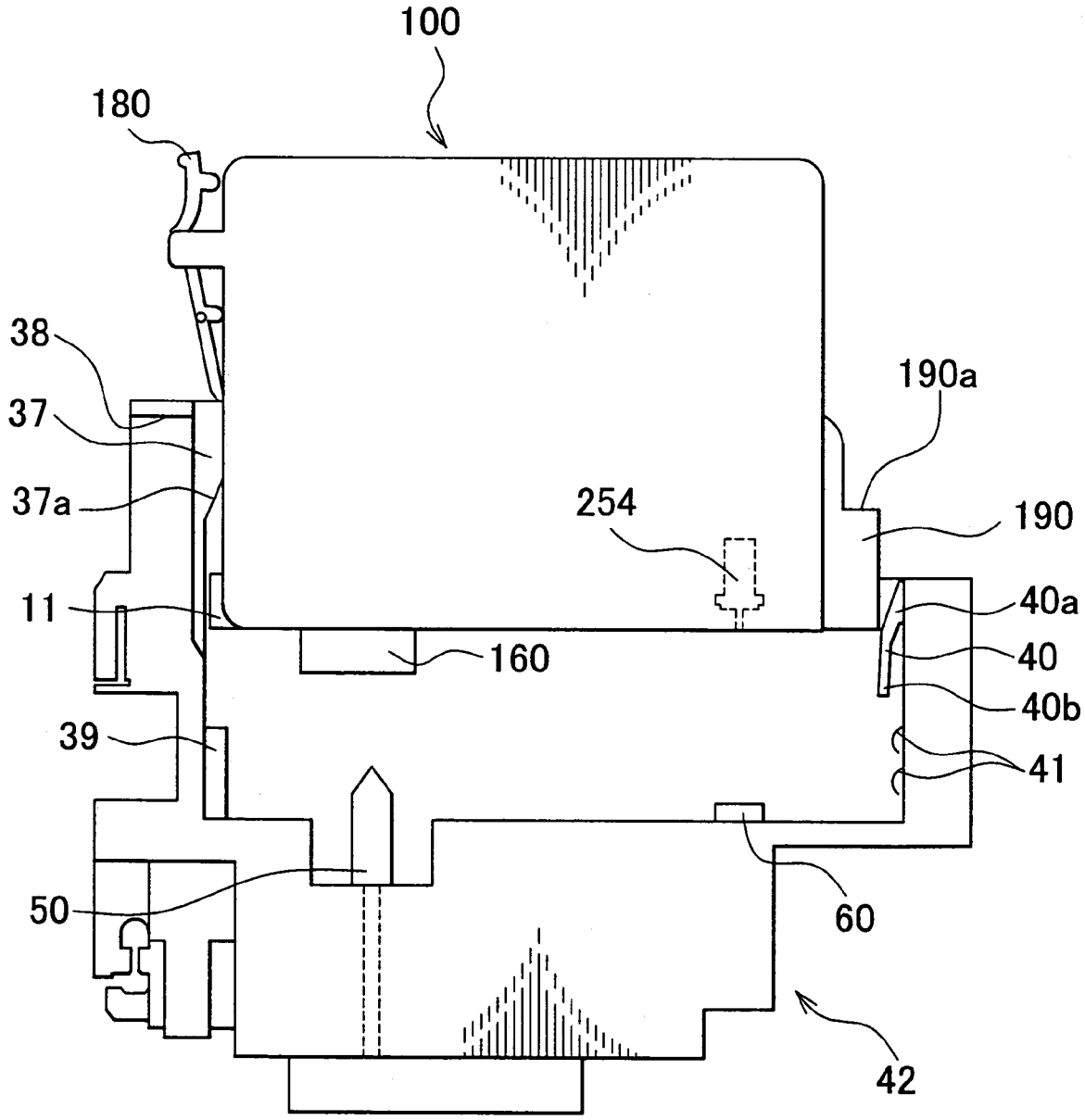
FIG. 11 is a schematic cross-sectional view that shows a relation between an ink cartridge 100 and a carriage 42.
Figure 12:
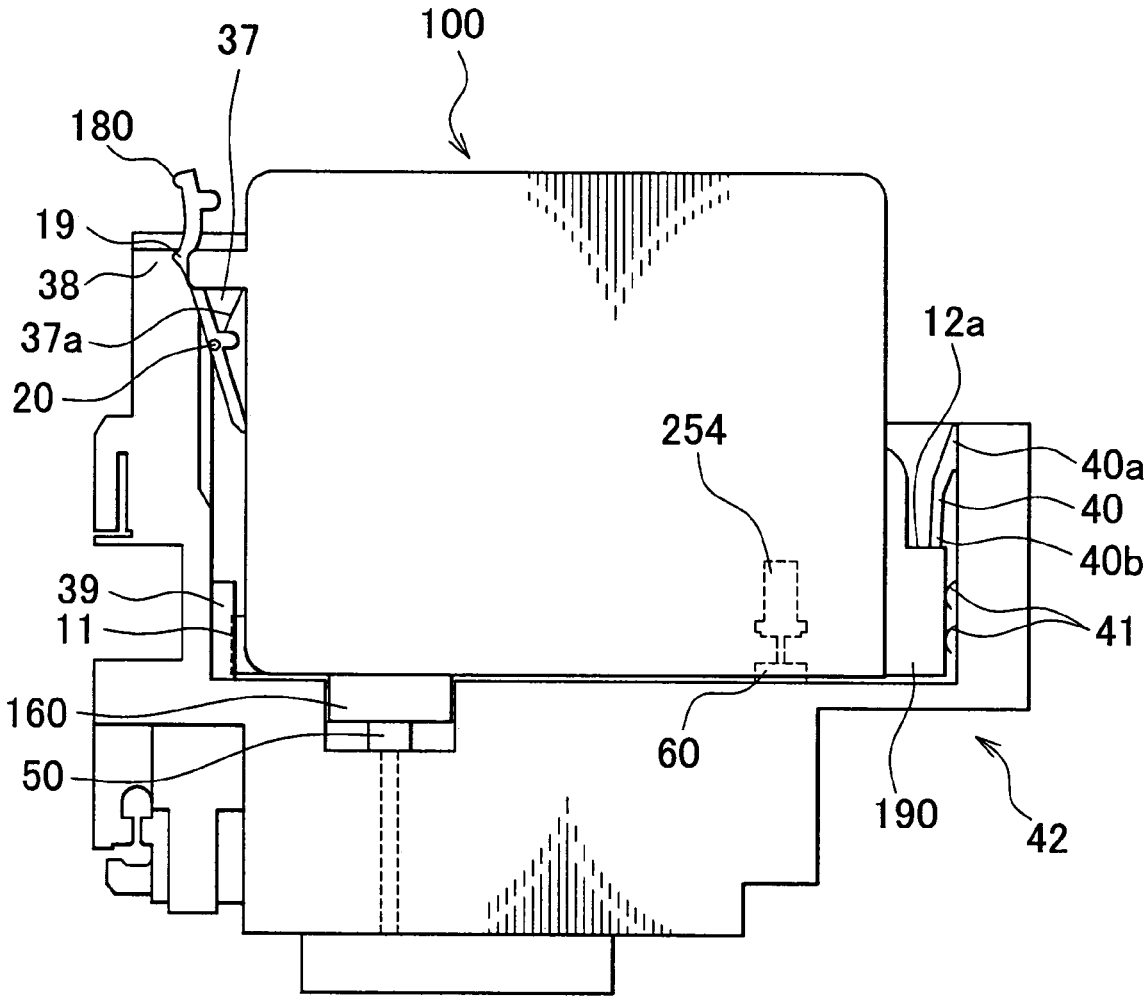
FIG. 12 is a schematic cross-sectional view that shows a relation between an ink cartridge 100 and a carriage 42.

FIG. 10 is a perspective view of the carriage 42 of the inkjet type recording apparatus and the ink cartridge 100, which is mounted on the carriage 42. FIG. 11 and FIG. 12 are schematic cross-sectional views that show how the carriage 42 is mounted onto the ink cartridge 100. FIG. 11 and FIG. 12 simplify and show the carriage 42 of the ink cartridge 100.

As shown in FIG. 10, the carriage 42 has the shape of a generally box of which an upper face is opened, and holds a plurality of the ink cartridges 100 that is mounted from the upper face. In the embodiment shown in FIG. 10, an internal side of the carriage 42 is provided with three ribs 33. Between those ribs 33 and between the ribs 33 and a side face of the carriage 42, three color ink cartridges having the same shape as one another and an black ink cartridge having a different thickness from the others are mounted.

Ink supplying needles 50, which are inserted into the ink supplying part 160, are provided respectively on a bottom face of the internal side of the carriage 42 and at a position of the ink supplying part 160 when the ink cartridge 110 is mounted. The ink supplying needle 50, which has the shape of a hollow needle of which the tip has a conical shape, supplies ink supplied from the ink supplying part 160 to the recording head. Further, contact members 60, which press the atmospheric valve 254 upwardly, are provided respectively on the bottom face of the internal side of the carriage 42 and at a position facing the atmospheric valve 254 of the ink cartridge 100 when the ink cartridge 100 is mounted.

A groove part 37, which is engaged with a projection 20 of the engaging lever 180, and an engagement concave part 38, which is engaged with a nail part 19, are provided on a side face of the carriage 42 facing the engaging lever 180. The groove part 37 is provided with a groove part 37*a* of which an upper part is broad towards the ink cartridge 100 side. This groove part 37 guides the projection 20 that is formed at both side faces of the engaging lever 180 while the ink cartridge 100 is mounted, and besides opens and holds the engaging lever 180 to the outside of ink cartridge 100 in the state wherein the ink cartridge 100 is mounted.

A guide groove part 39 is provided at a lower side of the groove part 37 of the carriage 42. The guide groove part 39 accepts a guide projection part 11 of the ink cartridge 100 when the ink cartridge 100 is deeply inserted into the carriage 42, and prevents the looseness of the ink cartridge 100 in a longitudinal direction in the state the ink cartridge 100 has been mounted.

As shown in FIG. 11, a positioning piece 40 is provided at a side face of the carriage 42 facing the memory 170 of the ink cartridge 100 and it has an upper end 40*a*, which is coupled with a side face of the carriage 42, and a lower end, which is in contact with an attaching face 190*a* of the attaching part 190 of the ink cartridge 100. Elastic contact points 41 are provided more downwardly than the positioning piece 40 to be in electronically contact with the terminals 171 of the memory 170 attached to the attaching part 190.

When the ink cartridge 100 is positioned upward the carriage 42 as shown in FIG. 11, the attaching part 190 is in contact with the positioning piece 40. At this situation, when the ink cartridge 100 is further pushed inside downwardly, the positioning piece 40 is pressed and deformed by the attaching part 190, and the attaching part 190 passes through the positioning part 40 and further moves downwardly. During this stage, the projections 20 at the both sides of the engaging lever 180 of the ink cartridge 100 are guided by the groove part 37*a*, and besides the guide projection part 11 goes into the guide groove part 39.

Further, when the ink cartridge 100 is pushed inside, the ink supplying needle 50 goes into the ink supplying part 160 and presses a supply valve 13 upwardly against an urging force of an urging member 14, while a contact member 60 presses the atmospheric valve 254 via the film 132, so that the atmospheric valve 254 opens the communicating hole 239.

Since the direction in which the atmospheric valve 254 moves is parallel to the direction in which the ink cartridge 100 is mounted onto the carriage 42 of the inkjet type recording apparatus, the atmospheric valve 254 is securely pressed upwardly accompanying mounting of the ink cartridge 100. Further, since the outward shape of the ink cartridge 100 is longitudinally long in the direction in which the ink cartridge 100 is mounted, it is possible to increase the stroke of the atmospheric valve that moves, without lengthening the width of the ink cartridge 100. In addition, since the atmospheric valve 254 is arranged near the attaching part 190 holding memory 170, it is possible to exactly position the atmospheric valve 254 and the contact member 60 by positioning the memory 170 against the carriage 42 and to securely open the atmosphere.

As shown in FIG. 12, when the ink cartridge 100 is pushed inside to a lower face of the carriage 42, the engaging lever 180 turns after the nail part 19 passes over an upper face of the engagement concave part 38, falls into the engagement concave part 38 by a strong elastic force and makes a strong click sound. Due to this, a user can confirm whether the ink cartridge 100 is securely mounted on the carriage 42.

Figure 13:
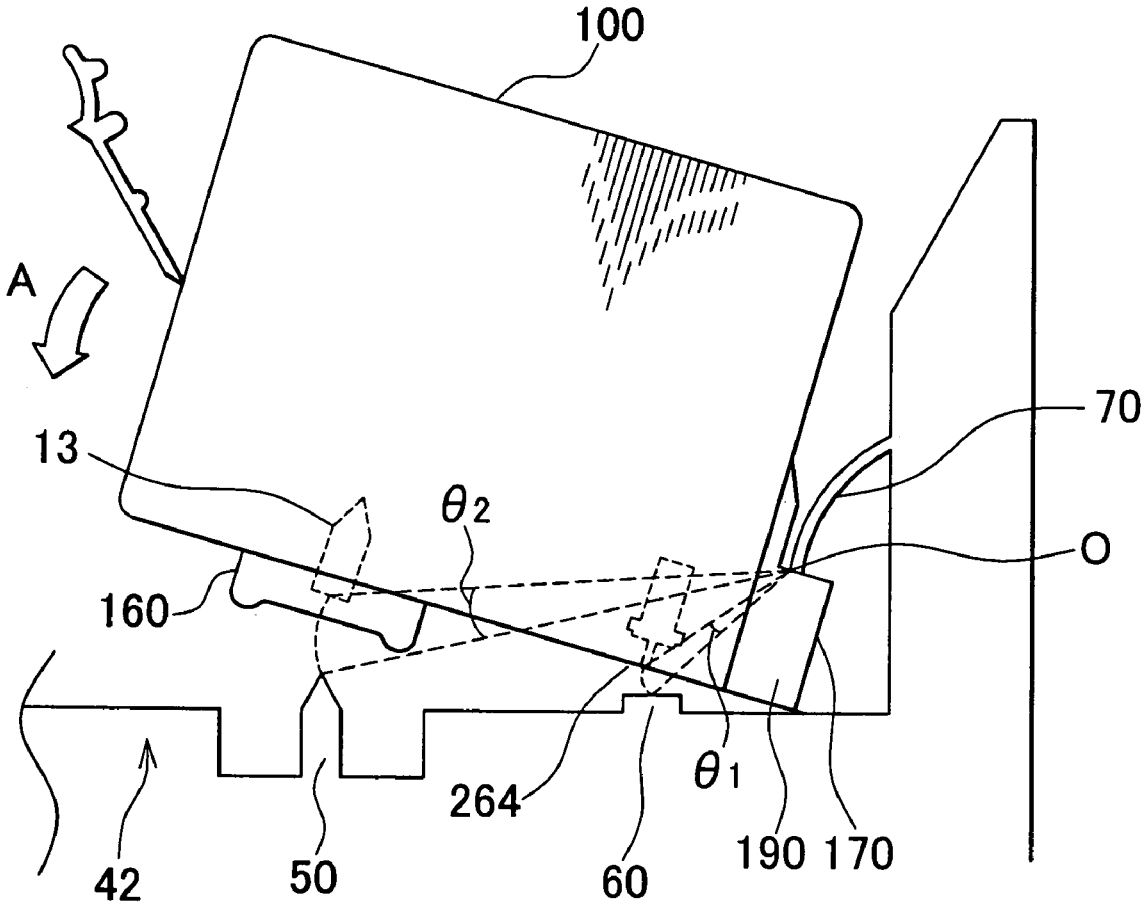
FIG. 13 is a schematic cross-sectional view that shows a relation between an ink cartridge 100 and another example of a carriage 42.

FIG. 13 is a schematic cross-sectional view that shows another example of the ink cartridge 100 mounted on the carriage 42. FIG. 13 also, like FIG. 11 and FIG. 12, simplifies the ink cartridge 100 and the carriage 42, so that the engaging lever 180 of the ink cartridge 100 in regard to the carriage 42 is omitted for purposes of description. In the carriage 42 in FIG. 13, the same configuration as that of the carriage 42 in FIG. 11 is given the same reference number, and the description of that will be omitted.

The ink cartridge 100 is mounted onto carriage 42 in FIG. 13 while turning. First, when the ink cartridge 100 is mounted on the carriage 42, an upper face of the attaching part 190, at which the memory 170 of the ink cartridge 100 is attached, is in contact with a lower face the contact part 70 of the carriage 42. Then, the ink cartridge 100 is mounted onto the carriage 42 by turning the ink cartridge 100 to the direction of an arrow A in the drawing, taking a contact point between the upper face of the attaching part 190 and the contact part 70 as the point O.

In the ink cartridge 100, the shaft part 264 of the atmospheric valve 254 is arranged near the point O more than the supply valve 13 of the ink supplying part 160. In addition, In the ink cartridge 100, an angle θ1, which is made by an lower end of the shaft part 264 of the atmospheric valve 254 and an upper face of the contact member 60 of the carriage 42 taking the point O as an axis, is smaller than an angle θ2, which is made by a lower face of the supply valve 13 of the ink supplying part 160 and the an upper end of the ink supplying needle 50. Therefore, an angle (θ1), by which the ink cartridge 100 turns in order for the atmospheric valve 254 to be in contact with the contact member 60, is smaller than an angle (θ2), by which the ink cartridge 100 turns in order for the supply valve 13 to be in contact with the ink supplying needle 50. Due to this, when the ink cartridge 100 is mounted on the carriage 42 while turning around the point O, the contact member 60 is in contact with the shaft part 264 before the ink supplying needle 50 is in contact with the supply valve 13, so that the atmospheric valve 254 is pressed upwardly. Therefore, the atmospheric valve 254 is pressed upwardly before the ink supplying needle 50 is connected with the ink accommodating section 111, and thus it is possible to allow the ink accommodating section 111 to communicate with the atmosphere.

Next, another embodiment of the atmospheric valve of the present invention will be described.

Figure 14A:
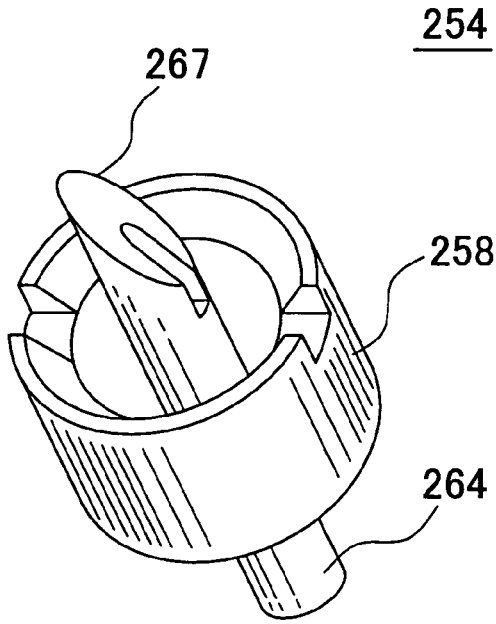
FIGS. 14A and 14B are perspective views of other examples of an atmospheric valve 254.
Figure 14B:
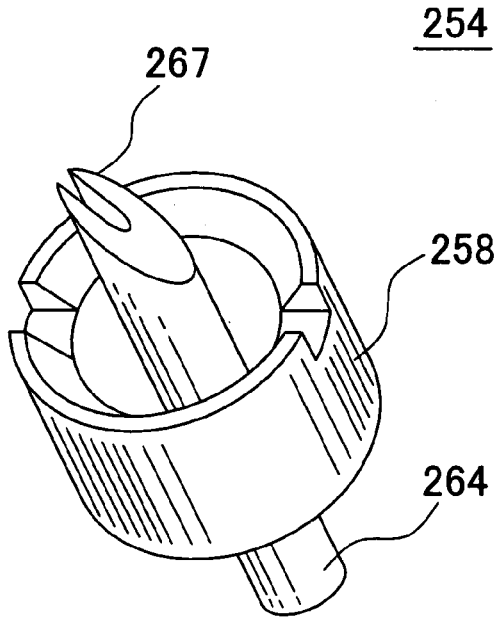
Figure 15:
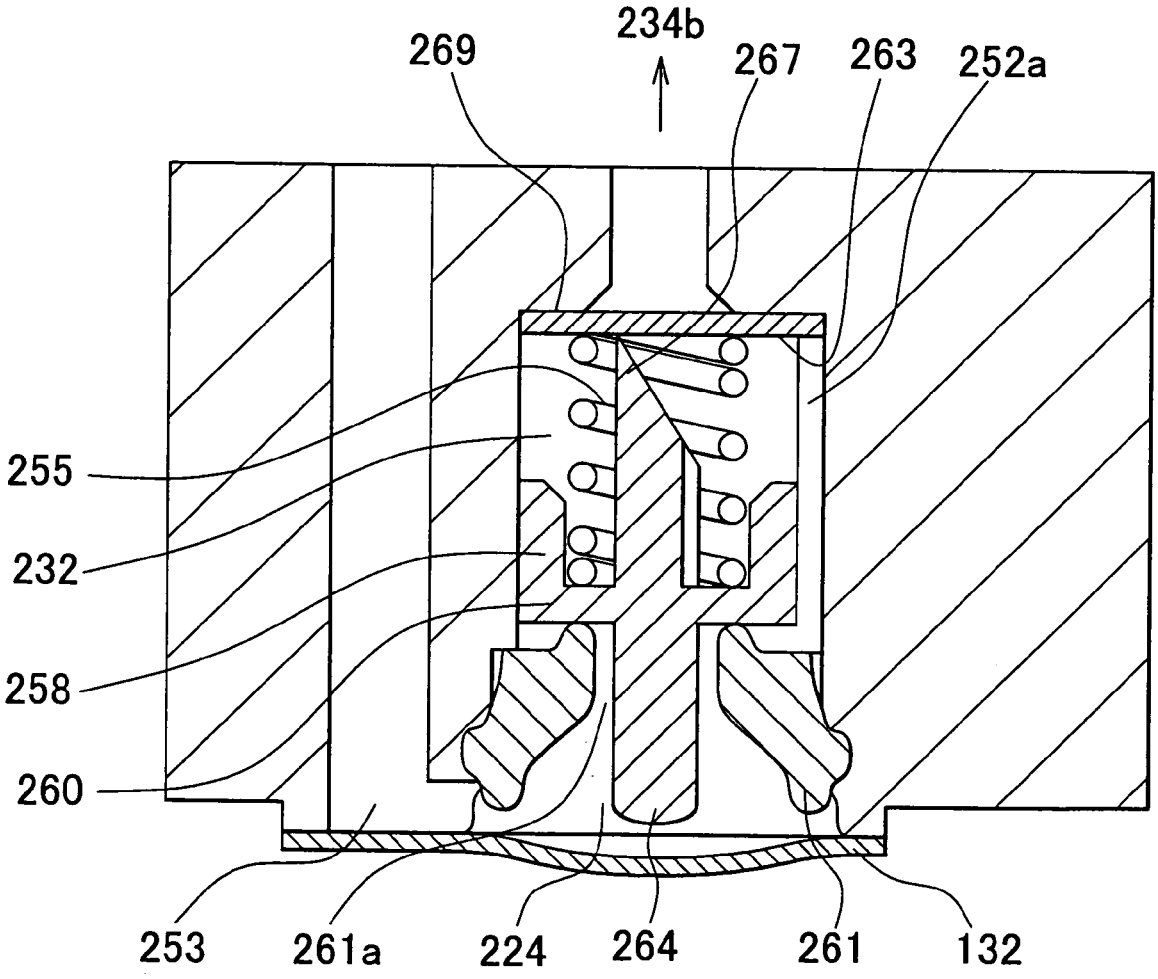
FIG. 15 is an enlarged cross-sectional view of an atmospheric valve accommodating chamber 232 in which an atmospheric valve 254 is contained.

FIGS. 14A, 14B and FIG. 15 shows structures of an atmospheric valve and an atmospheric valve containing chamber for containing the atmospheric valve relating to another embodiment of the present invention, and FIG. 14A and FIG. 14B are perspective views that show an atmospheric valve 254 having a needle part 267. In this atmospheric valve 254, the same configuration as that in FIG. 9 is given the same reference number, and it will not be described.

The needle part 267 shown in FIG. 14A and FIG. 14B protrudes from an opposite side to a shaft part 264 more than a guide part 258, and has an end of an acute shape. The needle part 267 of the present embodiment is an example of a breaking means in the present invention.

FIG. 15 is an enlarged cross-sectional view that shows an example of the atmospheric valve accommodating chamber 232 of the ink cartridge 100 in which the atmospheric valve 254 in FIG. 14A is contained. In the atmospheric valve accommodating chamber 232 in FIG. 15, the same configuration as that of the atmospheric valve 250 shown in FIG. 6 is given the same reference number, and it will not be described.

The atmospheric valve accommodating chamber 232 shown in FIG. 15 has the shape of a hollow cylinder having an internal diameter that is approximately the same as an external diameter of a disc part 260 of the atmospheric valve 254. The atmospheric valve accommodating chamber 232 further has a passage 252*a* at a side face of the cylinder along an up-and-down direction in the drawing.

The atmospheric valve 254 is arranged in order for the needle part 267 to face a wall part 269 side of the atmospheric valve accommodating chamber 232. A seal film 263 is attached to the wall part 269 in order to face the needle part 267. This seal film 263 blocks between the atmospheric valve accommodating chamber 232 and a communicating chamber 234*b*. By the sealing film 263, it is possible to prevent the ink contained in the ink accommodating section 111 from leaking out to the atmosphere vale not to the communicating chamber 234*b* in use.

A seal member 261 is attached to an opposite side of the atmospheric valve accommodating chamber 232 to the wall part 269, and it consists of an elastic member having a hole part 261*a* at its center. A shaft part 264 of the atmospheric valve 254, which has a diameter smaller than the hole part 261*a*, protrudes from the hole part 261 of the seal member 261. A coil spring 255 urges the disc part 260 toward the seal member 261. Due to this, the disc part 260 is in contact with the seal member 261, and at this state the atmospheric valve 254 blocks between the atmospheric valve accommodating chamber 232 and the communicating part 224.

Further, an external side of the shaft part 264 is sealed by a film 132 in order to form a space for blocking the communicating part 224 from the atmosphere like the embodiment described above. This space communicates with the atmosphere via a communicating hole 253. After the film 132 is attached to the communicating part 224, a fixture, which has been heated, is applied thereto and pushes up the atmospheric valve 254 via the film 132 to a position at which the contact member 60 of the carriage 42 allows the atmospheric valve accommodating chamber 232 and the communicating part 224 to communicate with each other by pushing up the atmospheric valve 254, so that the film 132 is expanded. Due to this, the film 132 is provided with a flexure that enables the contact member 60 to push up the atmospheric valve 254 via the film 132 until the atmospheric valve 254 allows the atmospheric valve accommodating chamber 232 and the communicating part 224 to communicate with each other. Therefore, when the contact member 60 of the carriage 42 pushes up the atmospheric valve 254 via the film 132, the film 132 is prevented from being broken. In addition, it is possible to decrease the resistance to press the film 132.

When the ink cartridge 100 is mounted on to the carriage 42, the contact member 60 of the carriage 42 is in contact with the shaft part 264 of the atmospheric valve 254, and pushes up the atmospheric valve 254 against the urging force of the coil spring 255. Due to this, the disc part 260 of the atmosphere part 254 is separated from the seal part 261, and the atmospheric valve accommodating chamber 232 and the communicating part 224 communicate with each other through a passage 252*a*.

In the ink cartridge 100, a wall part 296 is attached to a seal film 263 at a state of the factory shipment. When the ink cartridge 100 is first mounted onto the carriage 42 after the factory shipment, the atmospheric valve 254 is pushed upwardly as described above, and thus an end of the needle part 267 of the atmospheric valve 254 penetrates the seal film 263. Due to this, the atmospheric valve accommodating chamber 232 and the communicating chamber 234*b* communicate with each other. When the ink cartridge 100 is mounted onto the carriage 42 for the first time by the needle part 267, the seal film 263 is securely torn.

Figure 16:
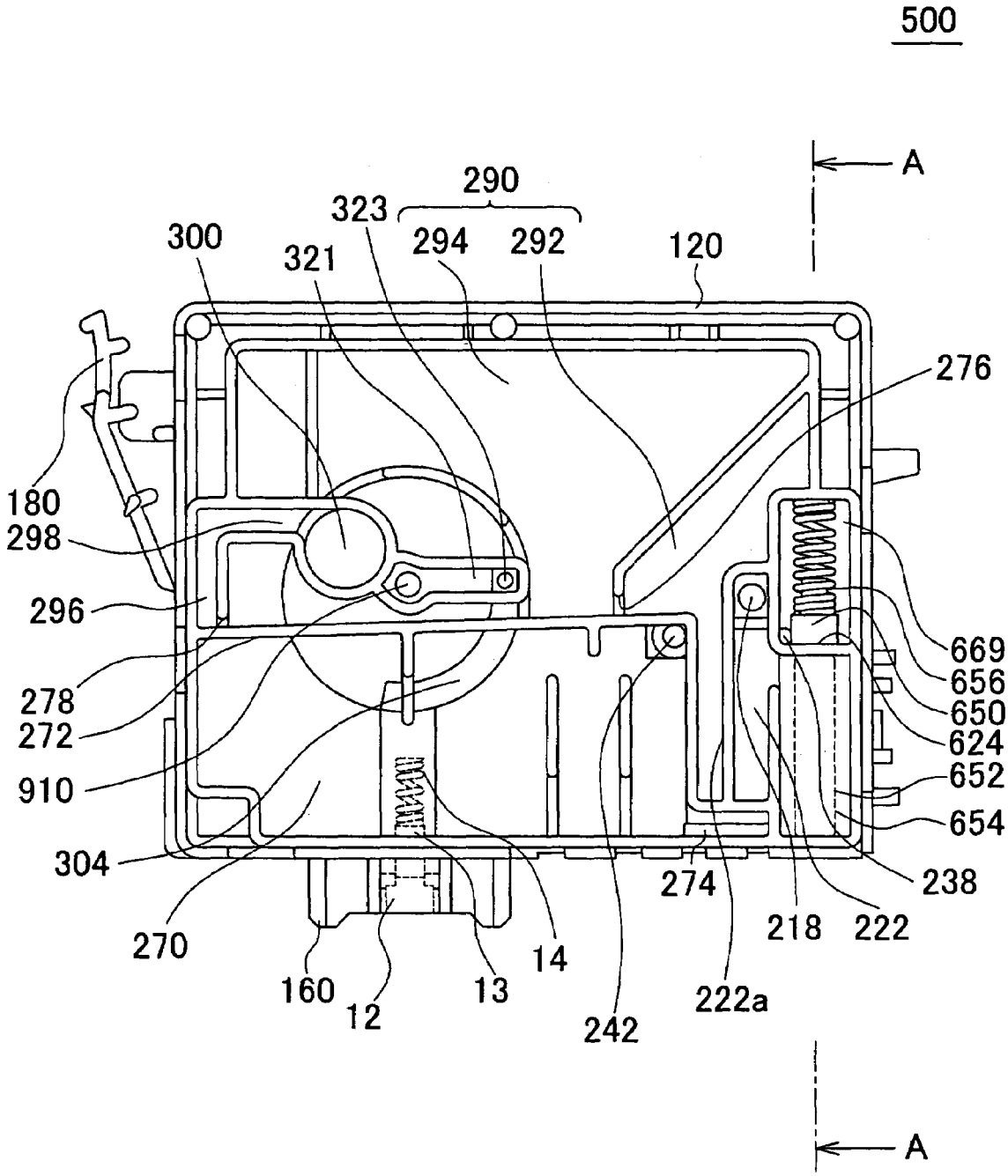
FIG. 16 is a plan view that shows an ink cartridge 500 of a second embodiment.
Figure 17:
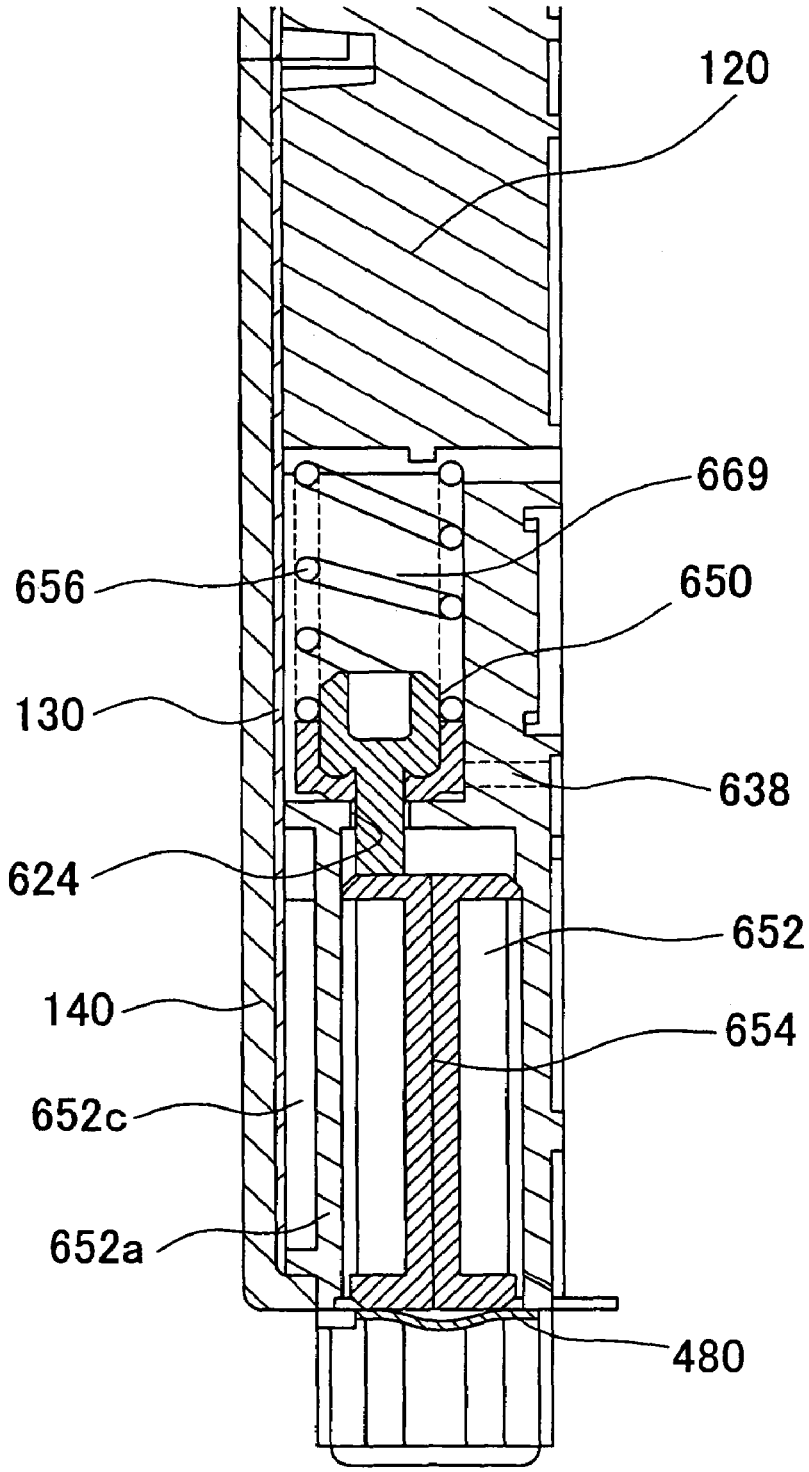
FIG. 17 is an enlarged view that shows a lower part of a cross-sectional A—A in FIG. 16.

FIG. 16 is a front perspective view of an ink cartridge 500 of another embodiment according to the present invention. FIG. 17 is an enlarged view that shows a lower part of a cross-section A—A in FIG. 16. In the ink cartridge 500 shown in FIG. 16, the same configuration as that of the ink cartridge 100 shown in FIG. 1 to FIG. 8 is given the same reference number, and it will not be described.

The ink cartridge 500 in FIG. 16 is different from the ink cartridge 100 shown in FIG. 1 to FIG. 8 in that a pushing member containing chamber 652 is provided at a lower side of an atmospheric valve chamber 669, in which an atmospheric valve 650 is contained, for containing an atmospheric valve pushing member 654, which pushes the atmospheric valve 650 upwardly.

As shown in FIG. 17, the atmospheric valve chamber 669 of the ink cartridge 500 is formed as a cartridge body 120 in association with a film 130. The film 130 seals the atmospheric valve 669, a lid body 140 is attached to an external side thereof, and thus the film is protected from being broken. An atmospheric valve communicating part 624 is formed at a bottom face of the atmospheric valve chamber 669. The atmospheric valve 650 is inserted inside the atmospheric valve chamber 669 together with a coil spring 656. The atmospheric valve 650 is integrally formed by a core, which is made of a material relatively hard, e.g., Polypropylene, and an elastic body, which is arranged at a circumference thereof and is made of a material relatively soft, e.g., elastomer. The coil spring 656 pushes the atmospheric valve 650 toward the circumference of the atmospheric valve communicating part 624 with an elastic force, and the atmospheric valve 650 seals the atmospheric valve communicating part 624. A shaft part with a small diameter, which is provided at a lower end of the atmospheric valve 650, protrudes from the atmospheric valve communicating part 624 to the pushing member containing chamber 652 provided at a lower part of the atmospheric valve chamber 669.

In the pushing member containing chamber 652, an upper face and four side faces are formed as a cartridge body 120, and it has a hollow part of an angular column in shape of which a bottom face is opened in order to contain the atmospheric valve pushing member 654 in the hollow part. Since the four side faces of the pushing member containing chamber 652 are formed as the cartridge body 120 that is made of hard resin, it is possible to reduce the looseness of the atmospheric valve pushing member 654. A film 480 is attached and sealed at a bottom face of a hollow part of the pushing member containing chamber 652 at a state the atmospheric valve pushing member 654 is contained in the hollow part. After the film 480 is attached to the bottom face of the pushing member containing chamber 652, a fixture, which has been heated, is applied to the film 480 and pushes up the atmospheric valve pushing member 654 via the film 480 to a position at which the atmospheric valve pushing member 654 opens the atmospheric valve communicating part 624 by pushing up the atmospheric valve 650, so that the film 480 is expanded. Due to this, the film 480 is provided with a flexure that enables a contact member 60 to push up the atmospheric valve pushing member 654 via the film 480 until the atmospheric valve 650 opens the atmospheric valve communicating part 624. Therefore, when the contact member 60 of the carriage 42 pushes up the atmospheric valve pushing member 654 via the film 480, the film 480 is prevented from being broken. In addition, it is possible to decrease the resistance to press the film 480.

Figure 18:
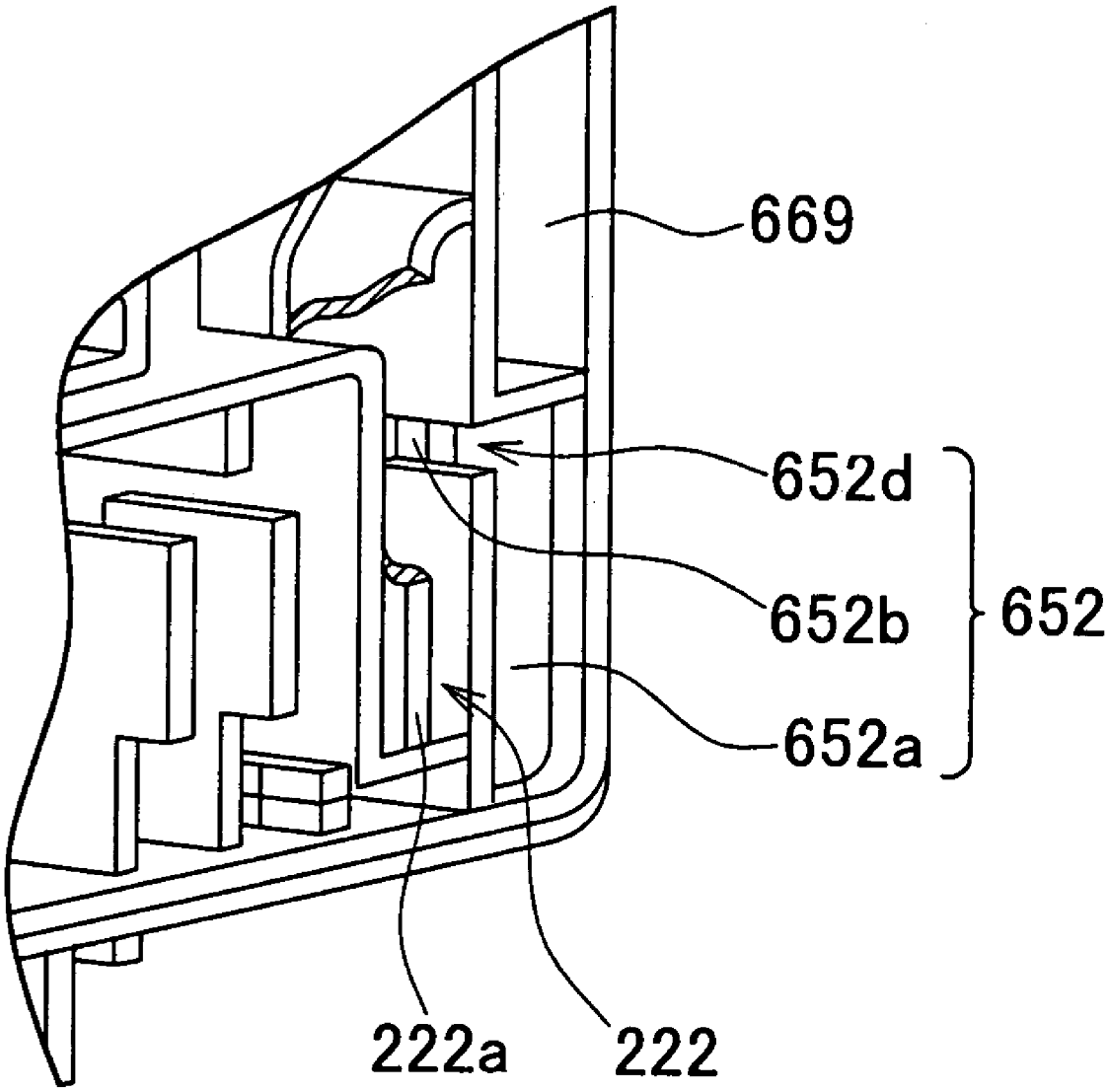
FIG. 18 is a partly enlarged view near a pushing member containing chamber 652.

FIG. 18 is a partly perspective view of the pushing member containing chamber 652 in FIG. 16. In addition, for purposes of description, a wall face 222*a* is shown being broken. A passage hole 652*b*, which is an example of a keeping part communicating hole, is provided at an upper part of a side face of a communicating part 222 in regard to the pushing member containing chamber 652, and communicates with the hollow part of the pushing member containing chamber 652 and the communicating part 222.

Due to this, in the state wherein the atmospheric valve pushing member 654 pushes up the atmospheric valve 650, the air flows into the atmosphere side accommodating section 270 via a sequence of the communicating hole 218, the communicating part 222, the passage hole 652*b*, the pushing member containing chamber 652, the atmospheric valve communicating part 624, the communicating hole 238 and the communicating hole 242, which communicate with the atmosphere.

The film 130 described above is attached to an external side of a side face 652*a* in regard to the pushing member containing chamber 652, so that a chamber 652*c* is formed. An upper part of the chamber 652*c* communicates with the communicating part 222 by a notch 652*d*. Due to this, when the air in the chamber 652*c* is expanded, it is possible to prevent the film 130 from being detached from the cartridge body 120.

Figure 19:
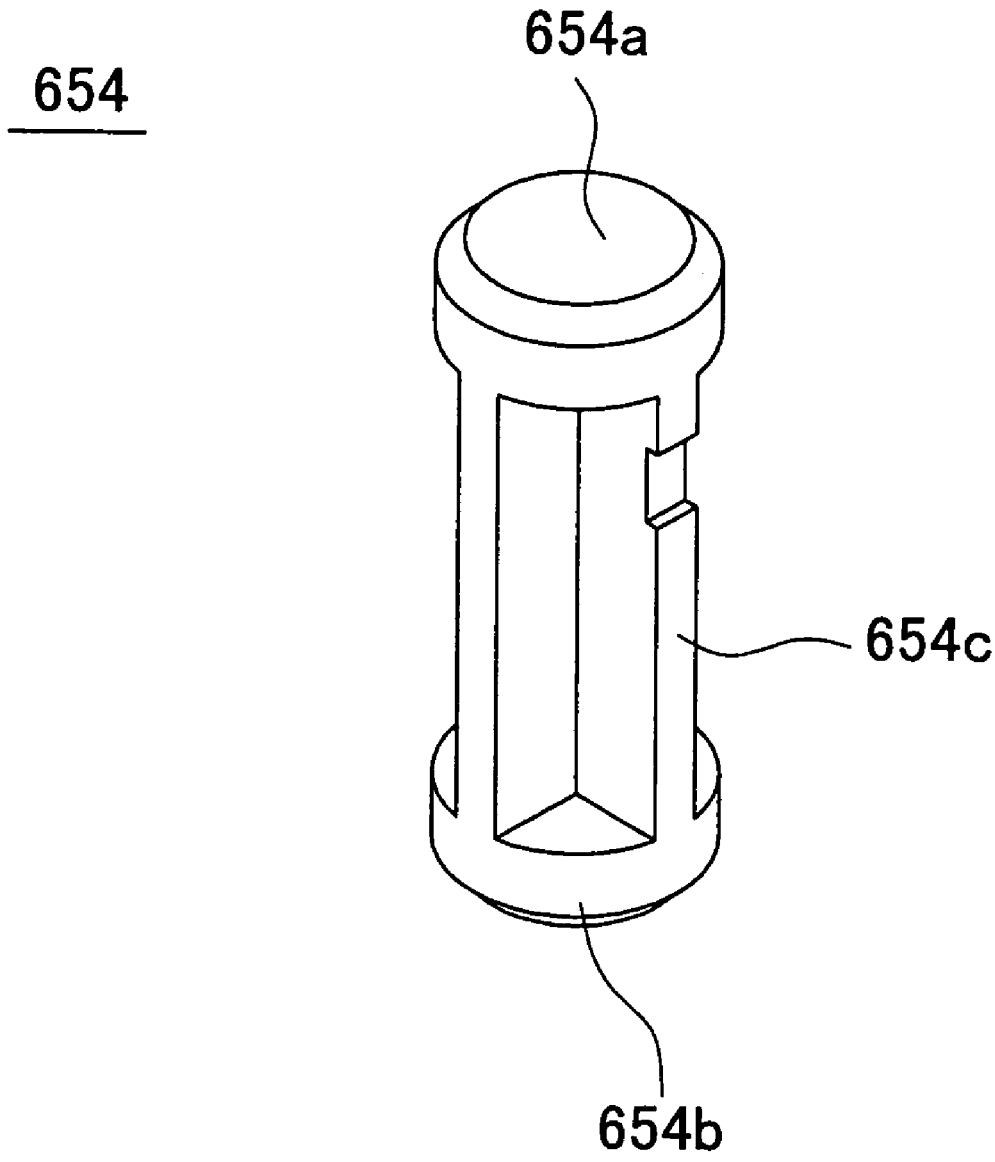
FIG. 19 is a perspective view of an atmospheric valve pushing member 654.

FIG. 19 is the perspective view of the atmospheric valve pushing member 654. The atmospheric valve pushing member 654 has a body part 654*c*, which extends downwardly and has a cross-shape in section, an upper face part 654*a* of a disc in shape provided at the top of the body part 654*c* and a bottom face part 654*b*, and is formed by, for example, injection molding with resin etc. By making the section of the body part 654*c* be a cross-shape, it is possible to reduce a sink of the upper face part 654*a* during injection molding, in comparison to the case of a cylinder having the same diameter as the upper face part 654*a*. In addition, a notch of the body part 654*c* shown in FIG. 19 becomes a gate when the atmospheric valve pushing member 654 is formed by injection molding.

The upper face part 654*a* of the atmospheric valve pushing member 654 is in contact with an end part of the atmospheric valve 650 at a position that deviate from the center of the upper face part 654*a*. Due to this, it is possible to allowing the upper face part 654*a* of the atmospheric valve pushing member 654 to be securely in contact with the end part of the atmospheric valve 650, avoiding the center which might bring about a concern that a concave part is formed by a sink of the atmospheric valve pushing member 654 during injection molding.

According to those configurations above, the pushing member containing chamber 652 is placed below the atmospheric valve 254 and the atmospheric valve communicating part 624 and is provided at the atmosphere side rather than the atmosphere communicating part 624, so that though the ink flows into the circumference of the atmospheric valve 254, the ink flows down to the pushing member containing chamber 652 through the atmospheric valve communicating part 624. Therefore, the pushing member containing chamber 652 is functioning also as a liquid keeping part of the present invention, it is possible to reduce the passage resist of the atmosphere flowing through the atmospheric valve communicating part 624, in comparison to a case that the ink is kept in the circumference of the atmospheric valve communicating part 624. In addition, since the passage hole 652*b* is provided at the upper part of the side face of the pushing member containing chamber 652, it is possible to prevent the ink, which is kept in the pushing member containing chamber 652, from flowing out of the pushing member containing chamber 652.

According to the present invention, it is possible to prevent the ink contained in the ink cartridge 100 or 500 from flowing out of the ink cartridge 100 or 500, and to allow the ink accommodating section 111 of the ink cartridge 100 to communicate with the atmosphere by pushing up the atmospheric valve 254 or 654 securely when the ink cartridge 100 or 500 is mounted on the carriage 42 of the ink jet type recording apparatus.

Although the present invention has been described by way of exemplary embodiments, it should be understood that those skilled in the art might make many changes and substitutions without departing from the spirit and the scope of the present invention which is defined only by the appended claims.

What is claimed is:

1. A liquid cartridge for supplying a liquid to a liquid ejecting apparatus through a liquid supplying needle thereof when mounted on said liquid ejecting apparatus, comprising:

a liquid accommodating section for containing a liquid;

a liquid supplying part, which communicates with said liquid accommodating section, said liquid supplying part including an opening into which the liquid supplying needle of the liquid ejecting apparatus is inserted; and an atmospheric valve for sealing a communicating hole which allows said liquid accommodating section to communicate with atmosphere, said atmospheric valve moving substantially in a direction parallel to a direction in which the liquid supplying needle is inserted into said opening of said liquid supplying part when the liquid cartridge is mounted on said liquid ejecting apparatus, in association with a part of the liquid electing apparatus;

an elastic member that urges said atmospheric valve toward said communicating hole to seal said communicating hole; and an atmospheric valve accommodating section for accommodating said atmospheric valve and said elastic member therein, said atmospheric valve communicating with said liquid accommodating section via a passage.

2. A liquid cartridge as claimed in claim 1, wherein said elastic member comprises a coil spring.

3. A liquid cartridge as claimed in claim 2, wherein said atmospheric valve comprises:

a guide part, which is of substantially cylindrical shape and inserted into said coil spring; and a disc part, which has a diameter larger than said guide part and is urged by said coil spring in order to seal around said communicating hole, and a notch part, which is cut in from a side into which said coil spring is inserted, being provided at said guide part.

4. A liquid cartridge as claimed in claim 1, further comprising a seal film for blocking between said liquid accommodating section and said communicating hole, and a tearing means for tearing said seal film when said liquid cartridge is mounted op said liquid ejecting apparatus.

5. A liquid cartridge as claimed in claim 1, further comprising an attaching part on which a memory is attached, of which a side face is positioned by the liquid ejecting apparatus, wherein said atmospheric valve is arranged near said attaching part.

6. A liquid cartridge as claimed in claim 1, wherein said liquid supplying part comprises a supply valve, which is pushed up by said liquid supplying needle when said liquid supplying needle of said liquid ejecting apparatus is inserted, and an angle, by which said liquid cartridge turns around said liquid ejecting apparatus in order that said atmospheric valve is in contact with said contact member of said liquid ejecting apparatus taking a point at which said liquid cartridge turns around said liquid ejecting apparatus as an axis, is smaller than an angle, by which said liquid cartridge turns around said liquid ejecting apparatus taking said point as an axis in order that said supply valve is in contact with said liquid supplying needle.

7. A liquid cartridge as claimed in claim 1, further comprising a check valve, which is provided between said liquid accommodating section and said communicating hole, for allowing atmosphere to flow from said communicating hole to said liquid accommodating section, and for inhibiting a liquid flowing from said liquid accommodating section to said communicating hole.

8. A liquid cartridge for supplying a liquid to a liquid ejecting apparatus through a liquid supplying needle thereof when mounted on said liquid ejecting apparatus, comprising:

a liquid accommodating section for containing a liquid;

a liquid supplying part, which communicates with said liquid accommodating section, said liquid supplying part including an opening into which the liquid supplying needle of the liquid ejecting apparatus is inserted; and an atmospheric valve for sealing a communicating hole which allows said liquid accommodating section to communicate with atmosphere, said atmospheric valve moving substantially in a direction parallel to a direction in which the liquid supplying needle is inserted into said opening of said liquid supplying part when the liquid cartridge is mounted on said liquid ejecting apparatus, wherein said atmospheric valve comprises:

a sealing part, which is urged in order to seal around said communicating hole; and a shaft part, which extends from said sealing part, is inserted into said communicating hole and touches said communicating hole internally at a plurality of places, wherein a gap is formed between said shaft part and said communicating hole.

9. A liquid cartridge for supplying a liquid to a liquid ejecting apparatus through a liquid supplying needle thereof when mounted on said liquid ejecting apparatus, comprising:

a liquid accommodating section for containing a liquid;

a liquid supplying part, which communicates with said liquid accommodating section, said liquid supplying part including an opening into which the liquid supplying needle of the liquid ejecting apparatus is inserted; and an atmospheric valve for sealing a communicating hole which allows said liquid accommodating section to communicate with atmosphere, said atmospheric valve moving substantially in a direction parallel to a direction in which the liquid supplying needle is inserted into said opening of said liquid supplying part when the liquid cartridge is mounted on said liquid ejecting apparatus, wherein a film is formed at a part of said liquid cartridge, with which a contact member of said liquid ejecting apparatus is in contact, and said atmospheric valve is moved by being pushed by said contact member via said film paying a flexure.

10. A liquid cartridge for supplying a liquid to a liquid ejecting apparatus through a liquid supplying needle thereof when mounted on said liquid ejecting apparatus, comprising:

a liquid accommodating section for containing a liquid;

a liquid supplying part, which communicates with said liquid accommodating section, said liquid supplying part including an opening into which the liquid supplying needle of the liquid ejecting apparatus in inserted; and an atmospheric valve for sealing a communicating hole which allows said liquid accommodating section to communicate with atmosphere, said atmospheric valve moving substantially in a direction parallel to a direction in which the liquid supplying needle is inserted into said opening of said liquid supplying part when the liquid cartridge is mounted on said liquid electing apparatus, further comprising a liquid keeping part, which is provided at a position closer to atmosphere than said communicating hole, below said atmospheric valve and said communicating hole, for keeping a liquid, which flows out of said communicating hole.

11. A liquid cartridge as claimed in claim 10, wherein a keeping part communicating hole is provided at an upper part of said liquid keeping part to allow atmosphere and said communicating hole of said liquid accommodating section to communicate.

12. A liquid cartridge as claimed in claim 10, wherein said liquid keeping part comprises a hollow part, of which a bottom face is opened, and a film for sealing said hollow part, and said liquid cartridge further comprises an atmospheric valve pushing member, which is contained in said hollow part of said liquid keeping part, for pushing up said atmospheric valve by said contact member formed at said liquid ejecting apparatus via said film.

13. A liquid cartridge as claimed in claim 12, wherein a flexure is provided at said film in order that said contact member of said liquid ejecting apparatus can push up said atmospheric valve pushing member via said film until said atmospheric valve opens said communicating hole.

14. A liquid cartridge mounted while being in contact with apart of a liquid ejecting apparatus and turning around said liquid ejecting apparatus, comprising:

a liquid accommodating section for containing a liquid;

a liquid supplying part, which communicates with said liquid accommodating section and has a supply valve pushed up by a liquid supplying needle when said liquid supplying needle of said liquid ejecting apparatus is inserted; and an atmospheric valve for scaling a communicating hole which allows said liquid accommodating section to communicate with atmosphere, while opening said communicating hole by being moved by a contact member formed at said liquid ejecting apparatus in a direction substantially parallel to a direction, in which said liquid supplying needle is inserted into said liquid supplying part, when said liquid ejecting apparatus is mounted, wherein an angle, by which said liquid cartridge turns around said liquid ejecting apparatus in order that said atmospheric valve is in contact with said contact member of said liquid ejecting apparatus taking a point at which said liquid cartridge turns around said liquid ejecting apparatus as an axis, is smaller than an angle, by which said liquid cartridge turns around said liquid ejecting apparatus taking said point as an axis in order tat said supply valve is in contact with said liquid supplying needle.

15. A liquid cartridge mounted while being in contact with a part of a liquid ejecting apparatus and turning around said liquid ejecting apparatus, comprising:

a liquid accommodating section for containing a liquid;

a liquid supplying part, which communicates with said liquid accommodating section and a liquid supplying needle of said liquid ejecting apparatus is inserted into; and an atmospheric valve for sealing a communicating hole which allows said liquid accommodating section to communicate with atmosphere, while opening said communicating hole by being moved by a contact member formed at said liquid ejecting apparatus in a direction substantially parallel to a direction, in which said liquid supplying needle is inserted into said liquid supplying part, when said liquid ejecting apparatus is mounted, wherein a contact part between said atmospheric valve and said contact member is provided at a position more closer to a point, at which said liquid cartridge turns around said liquid ejecting apparatus, than said liquid supplying part.

16. A liquid cartridge as claimed in claim 14 or claim 15, further comprising a liquid keeping part, which is provided at a position closer to atmosphere than said communicating hole, below said atmospheric valve and said communicating hole, for keeping a liquid, which flows out of said communicating hole.

17. A liquid cartridge as claimed in claim 16, wherein a keeping part communicating hole is provided at an upper part of said liquid keeping part to allow atmosphere and said communicating hole of said liquid accommodating section to communicate.

18. A liquid cartridge as claimed in claim 14 or claim 15, further comprising a seal film for blocking between said liquid accommodating section and said communicating hole, and a tearing means for tearing said seal film when said liquid cartridge is mounted.

19. A liquid cartridge as claimed in claim 14 or claim 15, wherein said atmospheric valve comprises:

a sealing part, which is urged in order to seal around said communicating hole; and a shaft part, which extends from said sealing part, is inserted into said communicating hole and touches said communicating hole internally at a plurality of places, wherein a gap is formed between said shaft part and said communicating hole.

* * * * *